United States Patent [19]

Matsumoto et al.

[11] Patent Number: 4,512,565

[45] Date of Patent: Apr. 23, 1985

[54] SORTER

[75] Inventors: Hiroshi Matsumoto; Yoshiaki Nawata, both of Yokohama, Japan

[73] Assignee: Tokyo Shibaura Denki Kabushiki Kaisha, Japan

[21] Appl. No.: 631,011

[22] Filed: Jul. 16, 1984

Related U.S. Application Data

[63] Continuation of Ser. No. 361,103, Mar. 23, 1982, abandoned.

[30] Foreign Application Priority Data

Mar. 30, 1981 [JP] Japan ..... 56-46740

[51] Int. Cl.[3] ..... B65H 31/24

[52] U.S. Cl. ..... 271/294; 271/293; 271/288; 271/208; 271/220

[58] Field of Search ..... 271/287, 288, 289, 290, 271/292, 293, 294, 208, 220

[56] References Cited

U.S. PATENT DOCUMENTS

| | | | |
|---|---|---|---|
| 3,768,806 | 10/1973 | Reehil | 271/155 |
| 3,845,949 | 11/1974 | Acquaviva et al. | 271/64 |
| 4,026,543 | 5/1977 | Leclere | 271/259 |
| 4,114,871 | 9/1978 | Botte | 271/173 |
| 4,218,129 | 8/1980 | Ishimoto et al. | 355/14 SH |
| 4,337,936 | 7/1982 | Lawrence | 271/293 |
| 4,361,393 | 11/1982 | Noto | 355/3 SH |

FOREIGN PATENT DOCUMENTS 3044783 7/1983 Fed. Rep. of Germany .

*Primary Examiner*—Bruce H. Stoner, Jr.
*Assistant Examiner*—James E. Barlow
*Attorney, Agent, or Firm*—Cushman, Darby & Cushman

[57] ABSTRACT

Disclosed is a sorter which has a controller for receiving a reset signal generated by a copying machine main body and for positioning sort bins in a sort home position in response to the reset signal.

11 Claims, 37 Drawing Figures

SORTER

This is a continuation of application Ser. No. 361,103, filed Mar. 23, 1982, now abandoned.

BACKGROUND OF THE INVENTION

The present invention relates to a sorter for an image formation device or the like.

In a conventional sorter mounted on a delivery section of an image formation device such as a copying machine, sort bins are sequentially moved to sort copied paper sheets fed out from the delivery section. Thus, the copied paper sheets are sorted in a plurality of bins. The sorted copied paper sheets are taken out by the operator when copying is completed.

However, in the conventional sorter of this type, when sorting for the preset copying sheet number is completed and then the subsequent sorting for a different preset copying sheet number is to be performed, a sort signal for the first sorting may be superposed on a sort signal for the second sorting, thus resulting in mechanical trouble such as jamming.

In order to prevent this, the operator must depress the operating buttons to maintain the sorter in the clear status or the reset status so as to return the sort bins to their home positions.

SUMMARY OF THE INVENTION

The present invention has been made in consideration of the above problem and has for its object to provide a sorter which has a controller for automatically moving sort bins to their home positions when a preset copying sheet number is changed.

In order to achieve the above object of the present invention, there is provided a sorter, electrically and mechanically connected to a copying machine main body having a function for generating a reset signal synchronously with an entry of a change in a preset copying sheet number by an operator, for sorting copied paper sheets fed out from said copying machine main body into sort bins by sequentially moving said sort bins with reference to a sort home position, characterized by comprising control means for moving said sort bins to the sort home position in response to the reset signal when the preset copying sheet number is changed.

According to the sorter of the present invention, the reset signal is generated synchronously with the entry of a change in the preset copying sheet number by the operator. The sorter includes a controller for moving the sort bins to the reference position (sort home position) in response to the reset signal. Therefore, a highly reliable and safe sorter of good operability can be manufactured according to the present invention.

BRIEF DESCRIPTION OF THE DRAWINGS

Other objects and many of the attendant advantages of the present invention will be readily appreciated as the same become better understood by reference to the following detailed description when considered in connection with the accompanying drawings, in which like reference characters designate the same or similar parts throughout the figures thereof and wherein:

FIGS. 4A and 4B show closing and opening sections of the sorter, in which FIG. 4A is a plan view thereof and FIG. 4B is a perspective view thereof;

FIGS. 5A and 5B show another embodiment of a transfer roller section, in which FIG. 5A is an exploded perspective view thereof and FIG. 5B is a plan view thereof;

DETAILED DESCRIPTION OF THE PREFERRED EMBODIMENT

Figure 1:
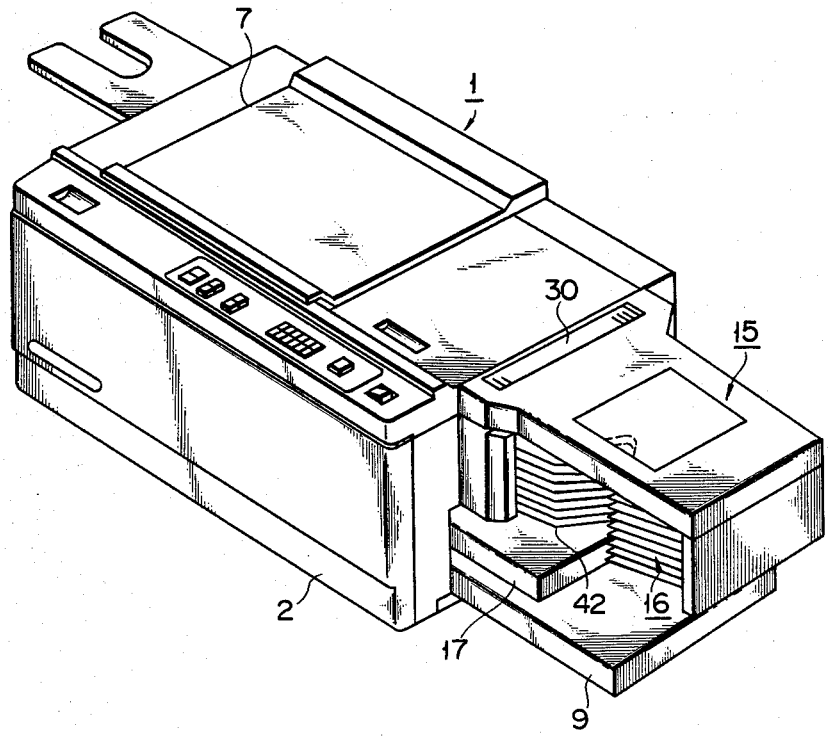
FIG. 1 is a perspective view of a sorter mounted to a copying machine according to one embodiment of the present invention.
Figure 2:
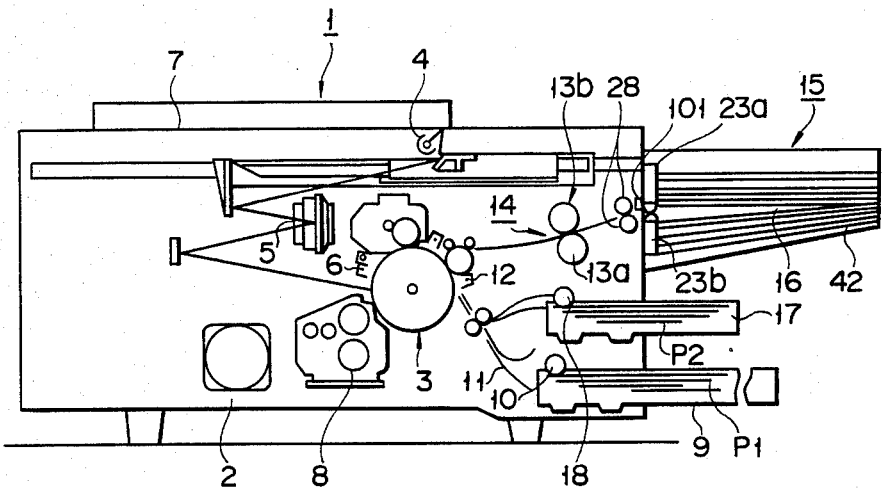
FIG. 2 is a schematic, longitudinal sectional view of the embodiment of FIG. 1.

FIG. 1 is a perspective view of a sorter mounted to a copying machine according to one embodiment of the present invention. FIG. 2 is a schematic, longitudinal sectional view thereof. A photosensitive drum 3 is disposed substantially at the center of a copying machine main body 2 of a copying machine 1 as the image formation device. A document on a document table 7 is exposed through an exposure unit 4, an optical system 5 and a charge unit 6 which are disposed on the circumference of the photosensitive drum 3. Thus, an electrostatic latent image is formed on the photosensitive drum 3. Further, a developer (to be referred to as a toner hereinafter) is attached to the electrostatic latent image by a developing unit 8. Thus, a toner image is formed. A paper feed cassette 9 is detachably mounted to one side (right side when viewed in the figure) of the copying machine main body 2. An uppermost copying paper sheet among copying paper sheets P1 stored in the paper feed cassette 9 is in contact with a paper feed roller 10. The copying paper sheet P1 driven by the paper feed roller 10 is fed out from the paper feed cassette 9. The copying paper sheet P1 is then guided between guide plates 11 and is brought into slidable contact with the circumference of the photosensitive drum 3. At this time, the toner image on the circumference of the photosensitive drum 3 is transferred by a transfer unit 12 to the copying paper sheet P1. The copying paper sheet P1 on which the toner image has been transferred is clamped and transferred between a pair of rollers 13*a* and 13*b* which comprise a fixing unit 14. The roller 13*a* among the pair of rollers 13*a* and 13*b* comprises a heat roller. After the toner image is fixed on the copying paper sheet P1, the copying paper sheet P1 is sorted into a bin section 16 of a sorter 15 mounted to the copying machine main body 2 through delivery rollers 28. Thus, the copied paper sheet is stored in the bin section 16. On the other hand, a paper feed cassette 17 is further disposed which stores a copying paper sheet P2 the size of which is different from that of the copying paper sheet P1 stored in the paper feed cassette 9. The copying paper sheet P2 is fed from the paper feed cassette 17 by a paper feed roller 18 as needed. A delivered paper detector 101 (to be referred to as a PIB detector hereinafter) is arranged to detect the trailing end of the copying paper sheet behind the delivery rollers 28. A delivered paper signal PIB generated from the PIB detector 101 is used in a controller to be described later.

Figure 4A:
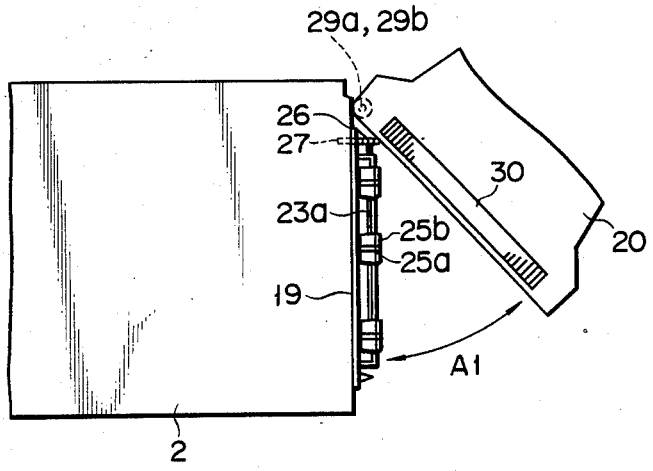
Figure 5B:
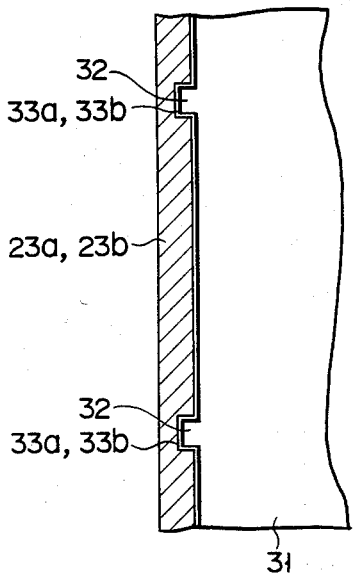

The sorter 15 comprises a stationary member 19 and a movable storage member 20 as shown in FIGS. 3 through 15. The stationary member 19 is mounted on the copying machine main body 2 by fixing pieces 21 such as screws. An insertion hole 22 for inserting the copied paper sheet fed out from the delivery section of the copying machine main body 2 is formed in the stationary member 19 (refer to FIGS. 3 and 4A). Support members 23*a* and 23*b* whose section is of a U shape are disposed above and below the insertion opening 22 to correspond each other. Transfer rollers 25*a* and 25*b* are disposed around shafts 24*a* and 24*b* and at corresponding positions of the support members 23*a* and 23*b*. A gear 26 is mounted on the rear side of the lower shaft 24*b*. The gear 26 is connected to a drive section of the delivery rollers 28 of the delivery section of the copying machine main body 2 through an idler gear 27. The gear 26 rotates in the same direction as the delivery rollers 28 rotates (refer to FIGS. 4B and 5). Pins 29*a* and 29*b* which pivotally support the storage member 20 in the direction indicated by an arrow A are mounted to the rear side of the stationary member 19. Further, the storage member 20 is detachably mounted to the rear side of the stationary member 19. The support member 23*a* serves to discharge hot air from the copying machine main body 2 through a discharge opening which is formed in the storage member 20. When projections 32 are to be formed at the top of each of bins 42, engaging recesses, for example, guide grooves 33*a* and 33*b* may be formed in the vertical direction as shown in FIGS. 5A and 5B, in order to prevent clamping of the copying paper sheet P between the top of each of bins and the support members 23*a* and 23*b*. Alternatively, engaging recesses and engaging projections may be, respectively, formed on the bins 42 and the support members 23*a* and 23*b*. Further, the upper transfer rollers 25*a* among the transfer rollers 25*a* and 25*b* may be made of iron material and the lower transfer rollers 25*b* may be made of rubber.

Figure 3:
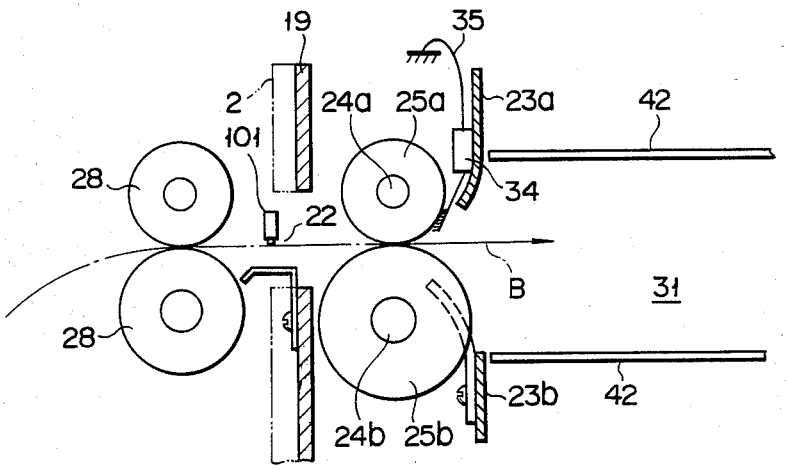
FIG. 3 is a sectional view of a delivery section and a transfer roller section of the embodiment of FIG. 1.
Figure 15:
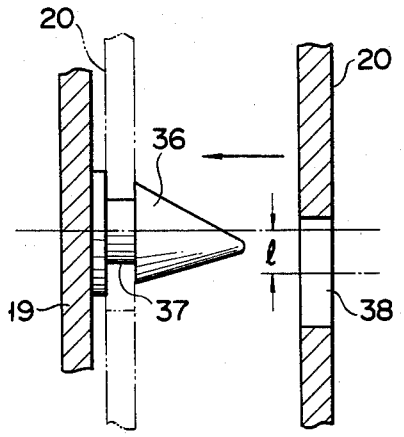
FIG. 15 is a sectional view of a stationary member and a movable member.

A discharger 34 is disposed on the support member 23*a* of the stationary member 19, as shown in FIG. 3. The discharger 34 is grounded through a lead wire 35. The discharger 34 comprises, for example, carbon fabric, and the lower end thereof is spaced apart from a transfer surface B of the copying paper sheet P. A holding piece 36 which holds storage member 20, when the storage member 20 is closed toward the stationary member 19 is mounted on the front side of the stationary member 19. The holding piece 36 is of conical shape whose top is eccentric downwardly, as shown in FIG. 15. A holding recess 37 is formed at the base side of the holding piece 36. The conical surface of the holding piece 36 of the stationary member 19 is guided to a fitting hole 38 which is formed in the storage member 20. The holding recess 37 is fitted with the fitting hole 38 so that the storage member 20 is held to the stationary member 19. When the storage member 20 is open, the center of the holding recess 37 of the stationary member 19 has a distance l from the center of the fitting hole 38 of the storage member 20. Therefore, the storage member 20 is lifted so as to detach the holding recess 37 from the fitting hole 38 and to be detached from the stationary member 19.

Figure 4B:
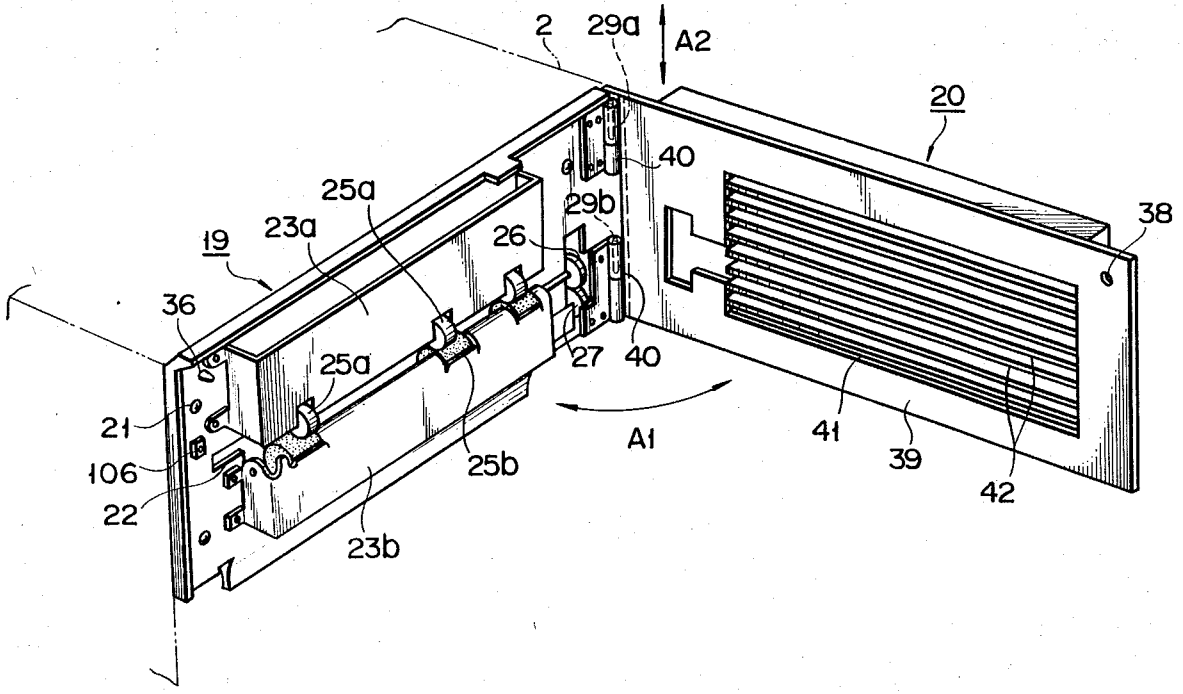
Figure 5A:
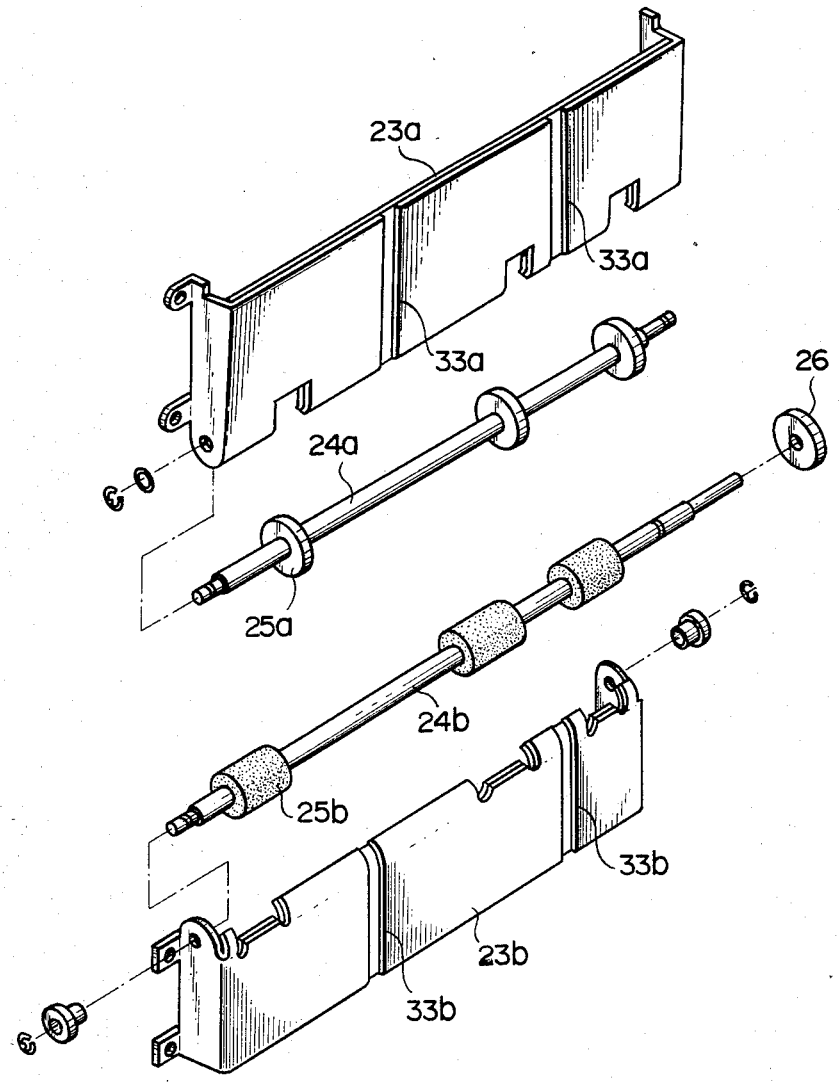

Engaging portions 40 on the rear side of a frame 39 engage with pins 29*a* and 29*b* of the stationary member 19 so that the frame is detachable in the direction indicated by an arrow A2 as shown in FIG. 4B and is free to open in the direction indicated by the arrow A1. The opening/closing operation of the storage member 20 is detected by a door switch 106 disposed below the holding piece 36 (FIG. 4B). The fitting hole 38 is formed on the front side of the frame 39 so that the holding piece 36 of the stationary member 19 is detachably fitted to the fitting hole 38. An opening 41 of rectangular shape is formed in the frame 39. Ends at one side of each of a plurality of bins (11 bins 42A through 42K in FIG. 6) are aligned in the opening 41. The bins 42 each comprise an elastic body such as a spring steel plate or a plastic plate. Projecting portions 43*a* and 43*b* are formed at both sides of the bins 42 on the frame side so as to oppose each other. The projecting portions 43*a* and 43*b* are not formed on the bins 42A. Sliders 44*a* and 44*b* of circular shape are fitted on the projecting portions 43*a* and 43*b*. The adjacent bins 42 are spaced apart by the sliders 44*a* and 44*b*.

Figure 10:
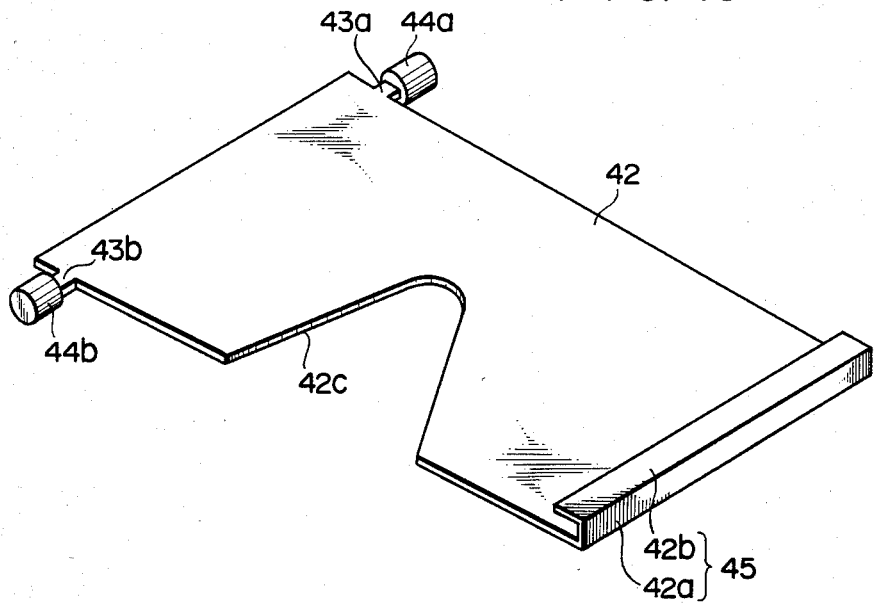
FIG. 10 is a perspective view of a bin.
Figure 12A:
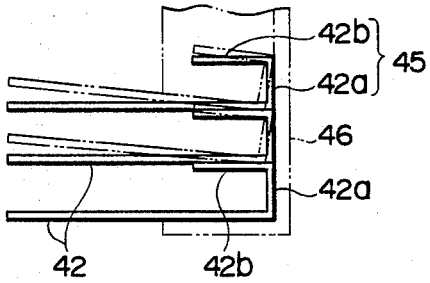
FIGS. 12A and 12B are views for explaining the end. portion of the bins.
Figure 12B:
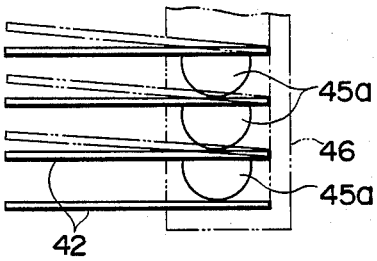
Figure 11A:
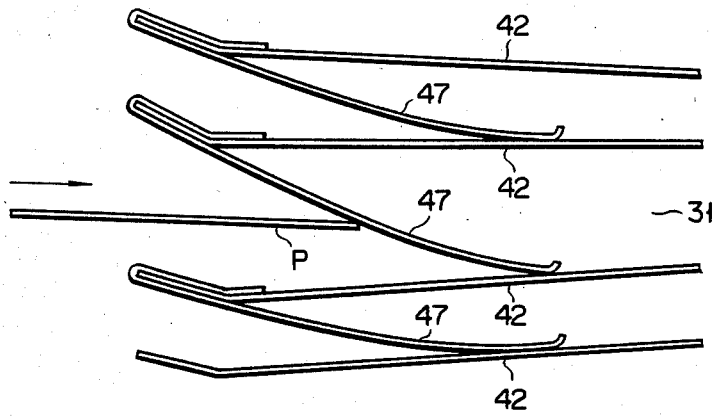
FIGS. 11A and 11B are views for schematically explaining the condition in which copying paper sheets are stored in a paper storage section.
Figure 11B:
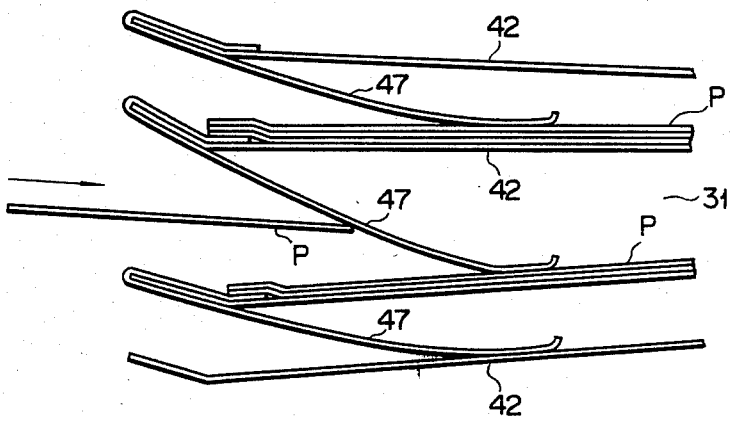
Figure 13:
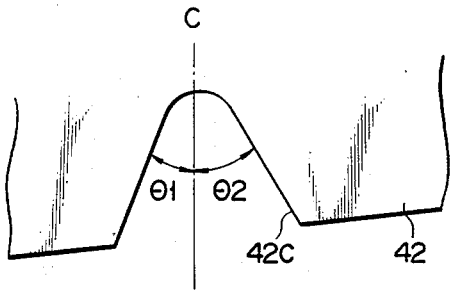
FIG. 13 is a schematic view for explaining the main part of the bin.

A projecting part 45 is formed at each of the bins 42 on the side opposite to the frame 39 so as to separate the adjacent bins, as shown in FIG. 12A. An edge of each of the bins 42 is bent upright to form an upright portion 42*a* and the upright portion 42*a* is bent in the horizontal direction parallel to each bin to form a horizontal portion 42*b*, as shown in FIG. 12A. As a result, the adjacent bins are spaced apart by the projecting part 45 which comprises the upright portion 42*a* and the horizontal portion 42*b*. As shown in FIG. 12B, a member 45*a* of substantially hemispherical shape may be mounted to each of the bins 42 so that the adjacent bins are spaced apart from each other. A guide member 46 is disposed on the side of the bin 42 opposite to the frame 39 so as to regulate the movement of the bin 42 (vertical direction and the right direction when viewed in the figure). Further, a notched portion 42*c* for taking out the stored paper sheets P is formed at the front middle portion of each of the bins 42, as shown in FIG. 10. In the notched portion 42*c* of each bin, as shown in FIG. 13, an angle $\theta 1$ formed between one edge of the notched portion 42*c* and a reference line C is smaller than an angle $\theta 2$ formed between the other edge of the notched portion 42*c* and the reference line C. Even if part of the copying paper sheets P stacked between the bins 42 hangs from the notched portion 42c, the copying paper sheets P move upward by the rear edge portions so that the stacked copying paper sheets P can be smoothly placed on the bins 42. As a modification thereof, one end of a regulating member 47 comprising a Mylar (a trademark) material may be mounted on the frame side of each of the bins 42 and the other end thereof may deposited between the adjacent bins, as shown in FIGS. 11A and 11B. Thus, the copying sheets P may be regulated so as not to float from the bin or to be misaligned. The width of the regulating member 47 and the number thereof may be arbitrarily determined in accordance with the size of the copying paper sheet P.

Figure 6:
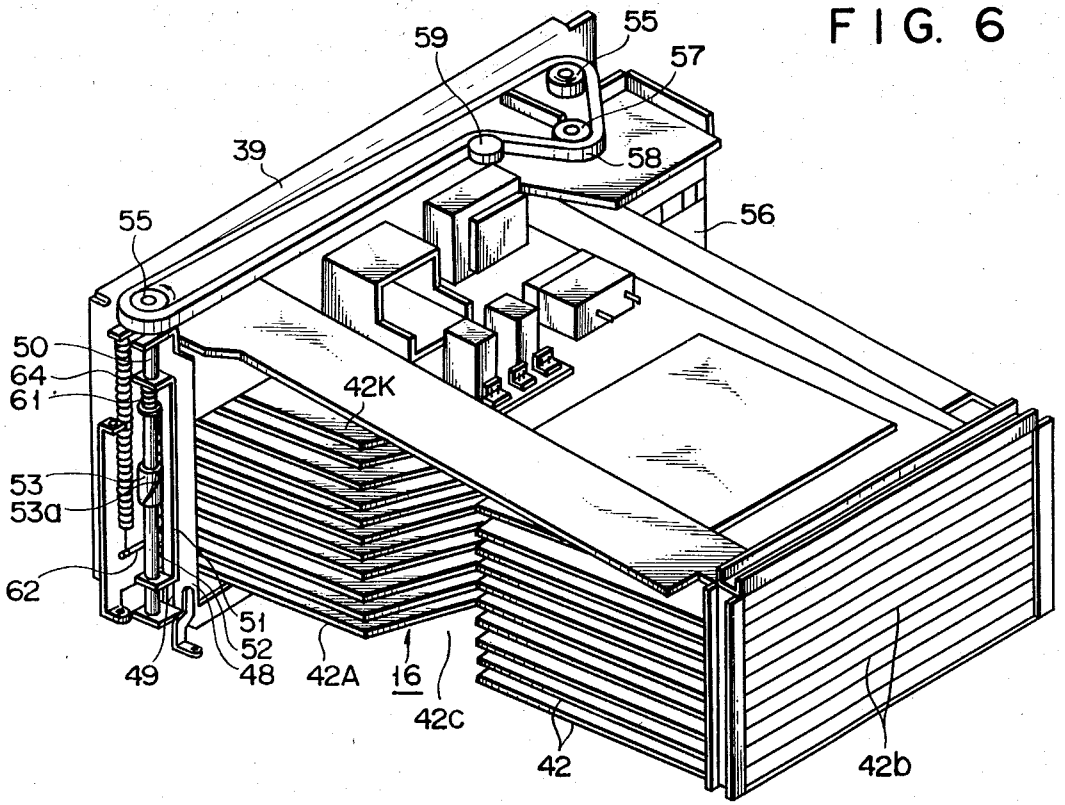
FIG. 6 is a perspective view of a storage member.

The sliders 44*a* and 44*b* of the bins 42 (42B through 42K) extend outside through an elongate hole 49 formed in the frame 48, as shown in FIGS. 6 through 9. Further, the sliders 44*a* and 44*b* extend through an elongate hole 52 of a movable member 51 which is movably mounted to a rotating shaft 50 disposed in the frame through a holding member 51A. The sliders 44*a* and 44*b* for each of the bins 42 come to engage with a cam 53 mounted at the middle of the rotating shaft 50. The rotating shaft 50 is disposed in the frame 48 through bearings 54*a* and 54*b*. A sprocket 55 is mounted to the upper end of the rotating shaft 50. A sprocket 57 which is connected to a bin actuating motor 56 is connected to the sprocket 55 through a chain 58 and an idler gear 59. Therefore, when the bin actuating motor 56 rotates in the forward/reverse direction, the cam 53 of the rotating shaft 50 is rotated in the forward/reverse direction (FIG. 6). A groove 53*a* of the cam 53 of the rotating shaft 50 is formed in a spiral shape with a predetermined angle so that the sliders 44*a* and 44*b* of the bins 42 move upward or downward every time the cam 53 revolves once. The cam 53 of the rotating shaft 50 is disposed substantially in the same position as the transfer surface B of the copying paper sheet P. The length of the cam 53 in the axial direction is substantially the same as the distance between the adjacent bins at their storage positions, that is, the pitch of paper storage sections 31 between the adjacent bins. A movable ring 60 is fitted on the rotating shaft 50. The movable ring is free to move in the axial direction and the lower part thereof is in contact with the sliders 44*a* and 44*b* of the uppermost bin 42K. The movable ring 60 is urged toward the uppermost bin 42K by a first urging member such as a compression spring 61 which is mounted to the lower part of the holding member 51A which is, in turn, firmly mounted to the upper end of the movable member 51. As a result, the sliders 44*a* and 44*b* of each of the bins 42 are in tight contact with the cam 53 so as to perform the movement of the bins properly (FIGS. 6 and 7A).

A pin 62 is mounted on the side of the lowermost bin 42A. The pin 62 extends through an elongate hole 63 formed to the outside in the frame 48. The other end of a second urging member such as a tension spring 64 whose one end is mounted on the frame 48 is mounted to this extended portion of the pin 62. The tension spring 64 serves to urge the bins 42 toward the cam 53. As a result, when the bins 42 located below the cam 53 are to be moved upward, these bins are properly moved. The projecting portions 43*a* and 43*b* and the sliders 44*a* and 44*b* are not formed on the side of the lowermost bin 42A. Therefore, the bin 42A moves within the elongate hole 63 and stops at the upper end of the elongate hole 63. At this position, the paper storage section 31 is thus formed between the lowermost bin 42A and the bin 42B.

Figure 7A:
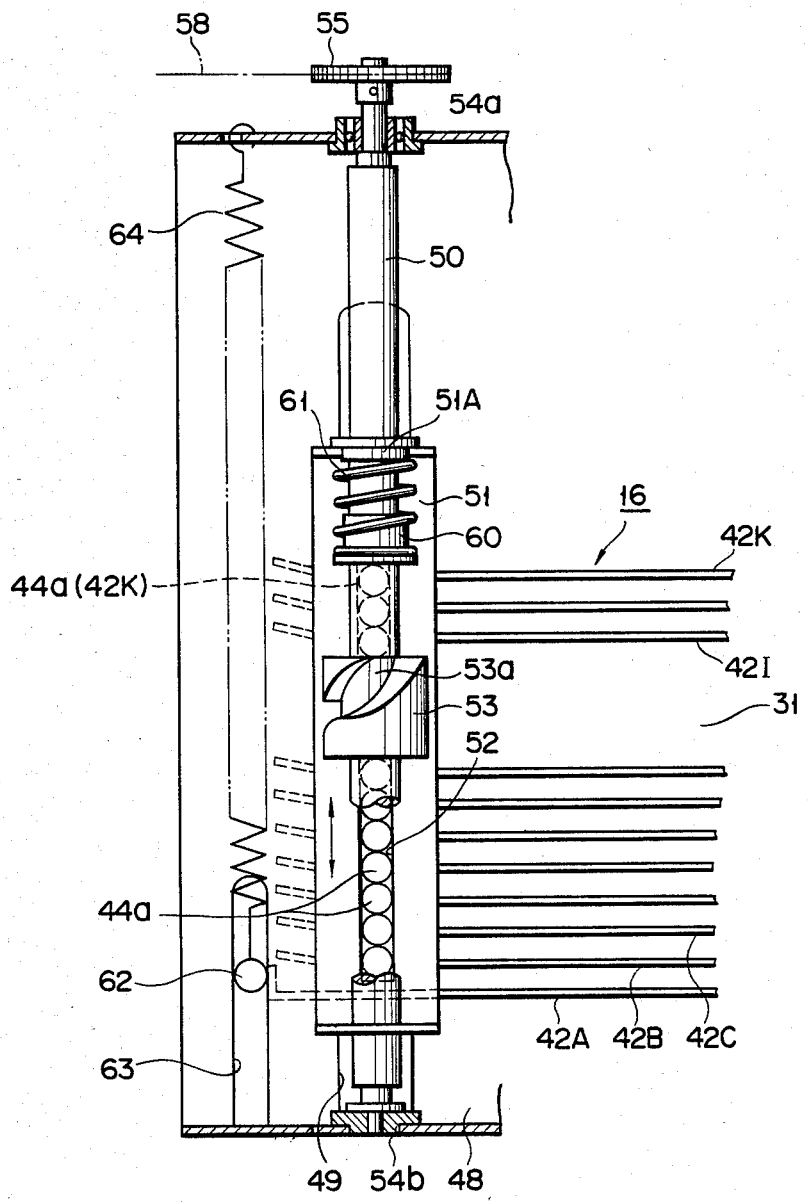
FIG. 7A is a side view of a lift mechanism which partially illustrates a section thereof.
Figure 7B:
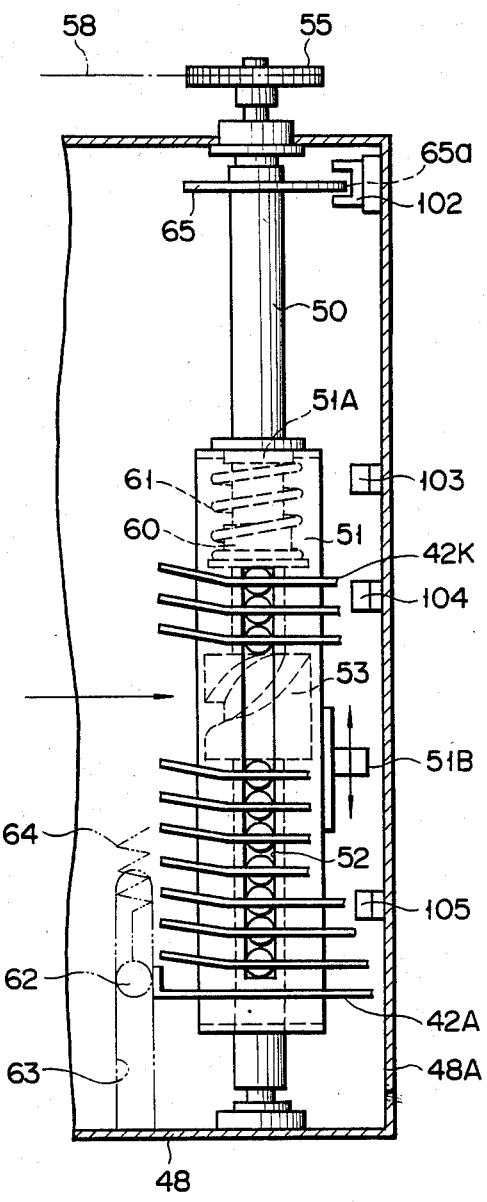
FIG. 7B is a side view for explaining the arrangement between respective detectors and the lift mechanism on the rear side.
Figure 8:
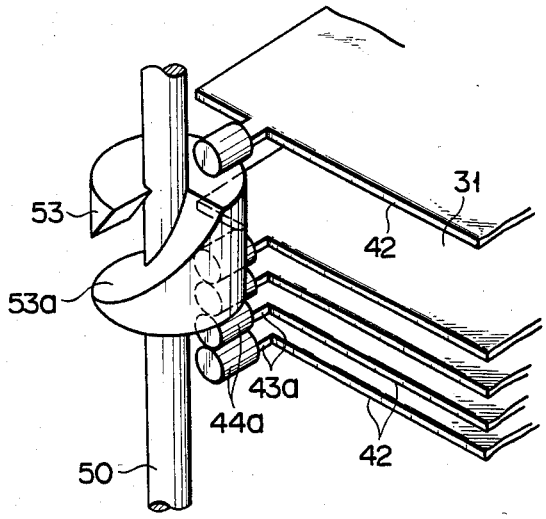
FIG. 8 is a perspective view of a cam section.
Figure 9:
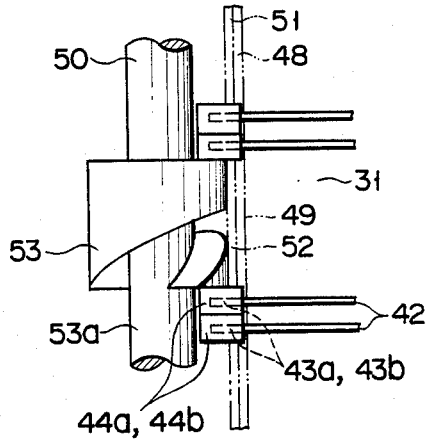
FIG. 9 is a side view of the cam section.
Figure 14:
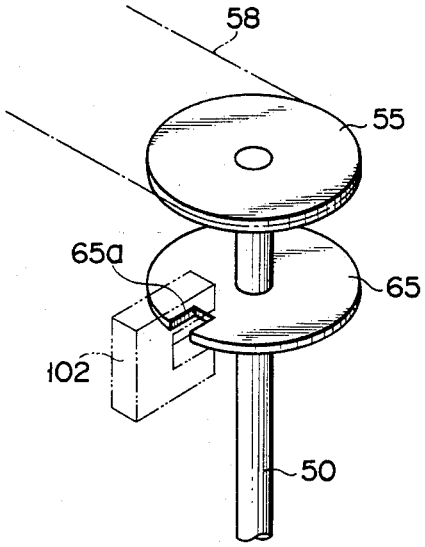
FIG. 14 is a perspective view of a detecting section which detects the cam rotation.

FIG. 7A shows the rotating shaft 50, the cam 53 and so on when viewed from the front side. The rotating shaft 50 and the cam 53 viewed from the rear side are shown in FIG. 7B. The main parts are the rotating shaft 50 disposed to be symmetrical with the members disposed on the front side, the movable member 51 disposed to be movable in the axial direction through the holding member 51A, and the cam 53 mounted at the center of the rotating shaft 50. The bins 42A through 42K are disposed in the same manner as those viewed from the front side. A sub-frame 48A is perpendicular to the rear frame 48 and extends therefrom so that the sub-frame 48A is parallel to the movable member 51. Four detectors 102 through 105 are disposed on the side surface of the sub-frame 48A so that the four detectors 102 through 105 are spaced apart from each other. The uppermost detector 102 (to be referred to as an OPTO detector hereinafter) is a one-revolution detector for detecting one revolution of the rotating shaft 50, that is, one revolution of the cam 53. The OPTO detector 102 is disposed so as to detect a notched portion 65*a* formed in part of a disc 65 mounted to the rotating shaft 50, as shown in FIG. 14. A signal OPTO generated from the OPTO detector 102 is processed by the controller to be described later and is used for intermittently driving the bin actuating motor 56. The second through fourth detectors 103 through 105 are arranged on the side of the movable member 51 so as to detect the state of an extended detector dog 51B. The detector 103 (to be referred to as an NHOM detector hereinafter) detects a non-sort home position, the detector 104 (to be referred to as an SHOM detector hereinafter) detects a sort home position, and the detector 105 (to be referred to as an LPOS detector hereinafter) detects the lower limit position.

When the detector dog 51B passes by the detectors 103 through 105, these detectors output a non-sort home position signal NHOM, a sort home positon signal SHOM and a lower limit position signal LPOS.

Figure 16:
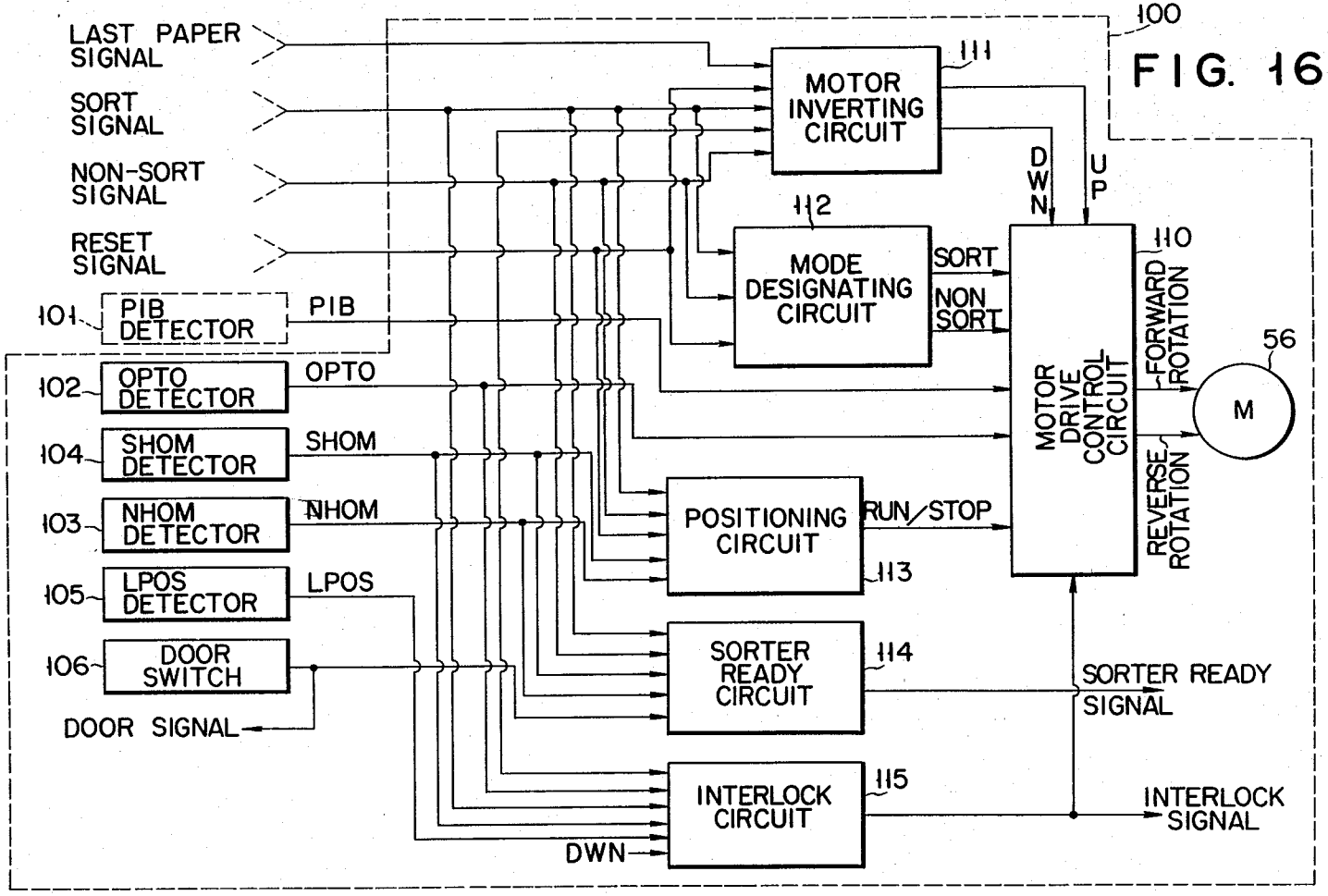
FIG. 16 is a block diagram of a controller within the sorter according to one embodiment thereof.

The structure of the controller 100 of the sorter 15 will be described with reference to the block diagram of FIG. 16. Signals generated from detectors 71 through 74 and the PIB detector 101 which are outside the broken line are generated from devices included in the copying machine main body 2. The portions surrounded by solid lines are included in the sorter 15. A last paper signal 71 is generated from the PIB detector 101 when the final copied paper sheet of the preset copying sheet number passes by the PIB detector 101. A sort signal 72 is generated when the operator depresses (on) a sort switch (not shown) disposed on the copying machine main body 2. A non-sort signal 73 is generated when the sort switch is depressed again, that is, the sort switch is turned off. A reset signal 74 is generated when the operator enters numerical values by the entry keys for presetting a copying sheet number in order to change the current preset copying sheet number. The on/off state of the sort switch is judged by the flashing of a lamp (not shown) arranged on the copying machine main body 2. The PIB detector 101 comprises a switch and is disposed at an outfeed opening of the copying machine main body from which the copied paper sheet is delivered. The PIB detector 101 outputs a signal PIB when the switch is turned off after the trailing end of the copying paper sheet passes by the switch. Other detectors 102 through 106 have the same arrangement as the PIB detector 101.

A motor drive control circuit 110 serves to drive the motor in response to the signal PIB generated by the PIB detector 101. Further, the motor drive control circuit 110 serves to stop the rotation of the motor in response to a signal OPTO generated by the OPTO detector 102 and to drive the bins downward (forward rotation) and upward (reverse rotation) in response to signals from circuits 111 through 113 to be described later.

The motor inverting circuit 111 outputs a forward rotation instruction signal (DWN) when it receives the sort signal 72. Thereafter, when the motor inverting circuit 111 receives the non-sort signal 72, it outputs a reverse rotation instruction signal (UP). Further, the motor inverting circuit 111 outputs the reverse rotation instruction signal (UP) when the sort signal 72 is already received and the signal PIB is being received from the PIB detector 101. The reverse rotation instruction signal is supplied to the motor drive control circuit 110. Further, when the sort mode is changed to the non-sort mode, or when the non-sort mode is changed to the sort mode, the motor inverting circuit 111 inverts the output only if the reset signal 74 is further received.

The mode designating circuit 112 outputs a sort mode signal (SORT) until the non-sort signal 73 is received when the sort signal 72 and the reset signal 74 are already received. On the other hand, when the non-sort signal 73 is supplied to the mode designating circuit 112, the mode designating circuit 112 outputs the non-sort mode signal (NON SORT) until the sort signal 72 and the reset signal 74 are received. These signals are supplied to the motor drive control circuit 110.

The positioning circuit 113 outputs a positioning signal RUN or a motor rotation signal when the sort signal 72, the non-sort signal 73 and the reset signal 74 are received. Further, when a signal SHOM from the SHOM detector 104 and a signal NHOM from the NHOM detector 103 are supplied to the positioning circuit 113, the positioning circuit 113 outputs a motor stop signal STOP. These signals RUN and STOP are supplied to the motor drive control circuit 110. When the positioning signal RUN is supplied to the motor drive control circuit 110, the motor drive control circuit 110 generates a motor rotation driving signal so as to rotate the bin actuating motor 56. The signal OPTO is generated by the OPTO detector 102 upon every revolution of the motor. In this case, the signal from the positioning circuit 113 has priority over the signal from the OPTO detector 102 so as to activate the motor drive control circuit 110.

A sorter ready circuit 114 outputs a non-ready signal when three conditions (i) to (iii) are met. When these three conditions are met, the sorter ready circuit 114 supplies a sorter ready signal to the copying machine. The conditions are that (i) an "open" state signal (door signal) is supplied to the copying machine from a door switch which detects the opening/closing condition of the sorter 15, (ii) the sorter ready circuit 114 does not output the sorter ready signal after the sort signal 72 is output and until the sort home position signal SHOM is generated, and (iii) the sorter ready signal is not supplied after the non-sort signal 73 is output and until the non-sort home position signal NHOM is generated. The sort ready circuit 114 generates the non-ready signal when the first copying and sorting operations are completed and the sort bins are moving to the reference sort home position for the subsequent copying operation. When the copying machine receives the non-ready signal, the copying machine controls so as not to perform the copying operation in a manner to be described later. When one of the following conditions is met, an interlock circuit 115 outputs an interlock signal so as to stop the rotation of the bin actuating motor 56. The first condition is met when the following three items are performed at once: (i) the signal LPOS is output by the LPOS detector 105; (ii) the reverse rotation instruction signal (UP) is generated by the motor inverting circuit 111; and (iii) the cam 53 stops at a normal position and the signal OPTO is generated by the OPTO detector 102. This state occurs when the preset copying sheet number is determined to be 11 even though only 10 sort bins are used. The second condition is met when the following four items are simultaneously satisfied; (i) the sort home position signal SHOM is output; (ii) the non-sort signal 73 is not output; (iii) the forward rotation instruction signal (DWN) is not supplied by the motor inverting circuit 111; and (iv) it is not a period between the generation of the sort signal 72 and the generation of the signal PIB, that is, it is not the first sort state in the sort home position. This state occurs when the number of sort bins which are selected for the first sorting is smaller than that of the sort bins which are selected for the next sorting. For example, 5 sort bins are selected for the first sorting and the preset number of sort bins for the second sorting operation is 6. Further, 10 sort bins for upper and lower sections are selected. The interlock signal is supplied to the motor drive control circuit 110 and simultaneously to the copying machine main body in the same manner as the door signal. Thus, the interlock signal is used for display.

Figure 19:
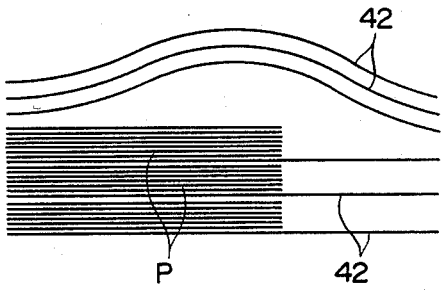
FIG. 19 is a view for schematically explaining the condition in which the sorted copied sheets are taken out.

The operation of the mechanisms of the sorter will be described with reference to FIGS. 17 through 19. For simplifying the description, cases are described in which the non-sort operation in single copying is performed, that is, only the lowermost bin 42A is used, and the sort operation in plural copying is performed, that is, the bins 42B through 42F, for example, are used. The lowermost bin 42A is called the non-sort bin and the bins 42B through 42K are called sort bins. When the bin actuating motor 56 (cam 53) rotates in the forward direction, the bin is moved downward. On the other hand, when the bin actuating motor 56 (cam 53) rotates in the reverse direction, the bin is moved upward.

(A) Non-Sort Operation

Figure 17A:
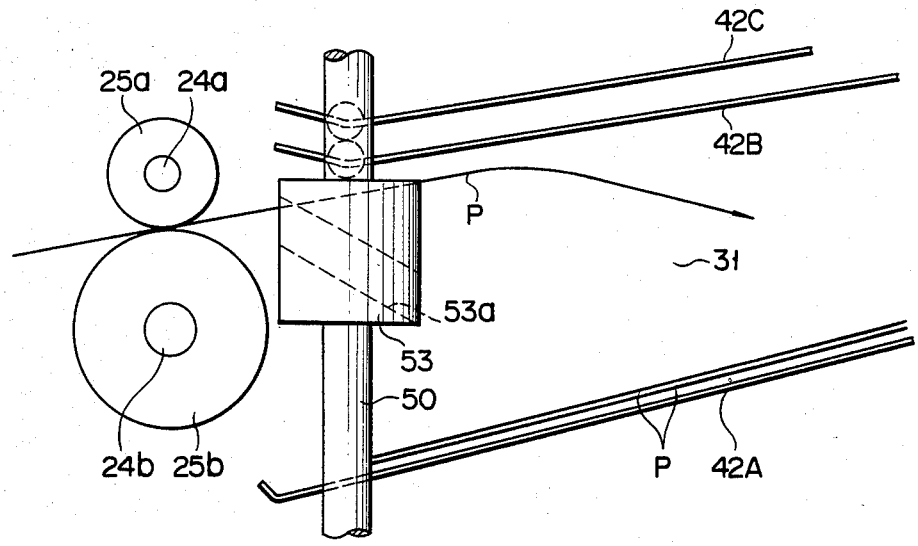
FIGS. 17A through 17D are views for schematically explaining the order of operation of the bins.
Figure 18A:
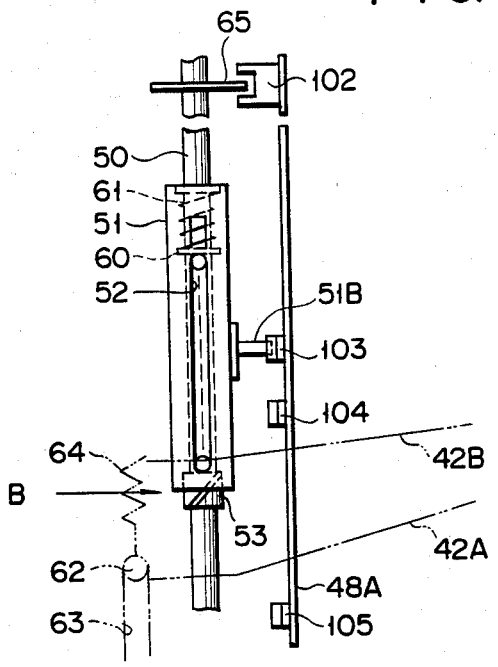
FIGS. 18A through 18D are views for schematically explaining the movement of the movable member when the sorter is operated.

The sort or non-sort mode is selected by using the operating keys (not shown) on the copying machine 1. The sliders **44*a* and 44*b* of the lowermost bin 42A are located below the cam 53 of the rotating shaft 50. The sliders 44*a* and 44*b* for other bins are located above the cam 53. Therefore, the paper storage section 31 is formed between the bin 42A and the bin 42B. The copying paper sheet P on which the toner image is fixed in the copying machine 1 is delivered through the delivery rollers 28 into the sorter 15. The copying paper sheets P guided into the sorter 15 are stored between the bin 42A and the bin 42B through the transfer rollers 25*a* and 25*b*. Subsequently, a predetermined number of copying paper sheets P are stored in the paper storage section 31 between the bin 42A and the bin 42B (FIG. 17A). In this case, if the regulating members 47 comprising Mylar material are mounted on the frame side of the bins 42, floating of the stored copying paper sheets P is prevented and the transferred copying paper sheets P are properly sorted, thus preventing clogging of the paper sheets. When the stacked paper sheets P are to be taken out from the portion between the bin 42A and the bin 42B after copying is completed, the central portion of the upper bin 42B is, for example, bent upward to widen the space between the bin 42A and the bin 42B for the stacked paper sheets P as shown in FIG. 19. In this condition, the positional relations between the respective detectors 102 through 105 and the movable member 51 and so on are shown in FIG. 18A. The sliders for the 10 sort bins 42B through 42K are stored in the elongate hole 52 of the movable member 51. The uppermost slider is in contact with the movable ring 60 which is, in turn, urged by a compression spring 61. The lower end of the lowermost slider is in contact with the upper surface of the cam 53. Therefore, the detector dog 51B mounted to the side of the movable member 51 serves to turn off the NHOM detector 103 and the non-sort home position signal NHOM is output by the NHOM detector 103. In this condition, since the rotation shaft 50 is not driven, the OPTO detector 102 does not produce the output signal. Further, signals are not generated from the other detectors 104 and 105. In this embodiment, the pin 62 mounted on the front end of the lowermost non-sort bin 42A is urged by the tension spring 64 to the upper end of the elongate hole 63 formed in the frame 48**.

(B) Sort Operation

Figure 17B:
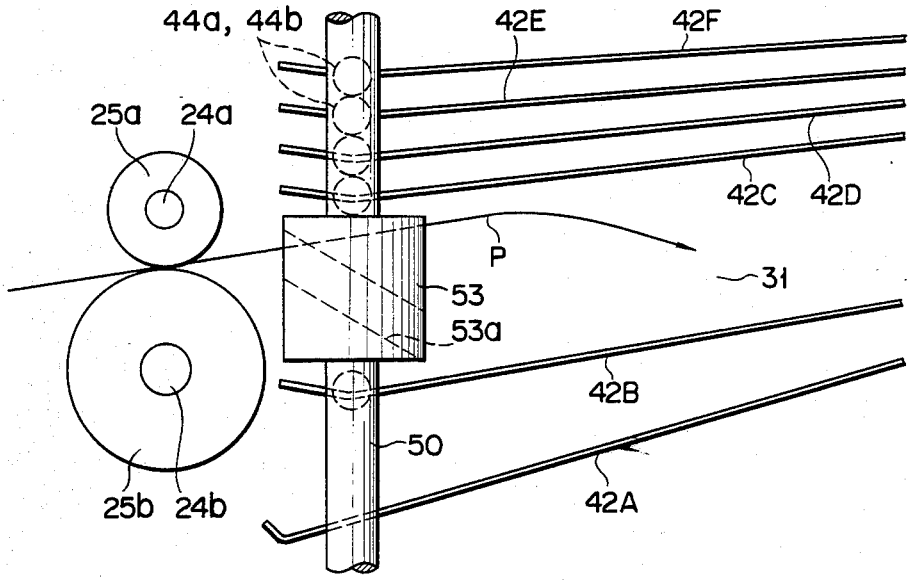
Figure 17C:
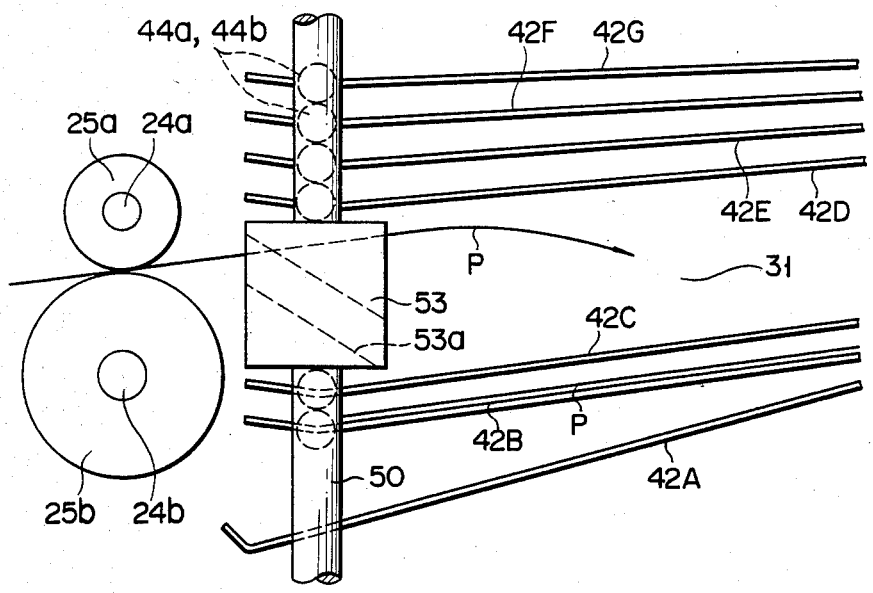
Figure 18B:
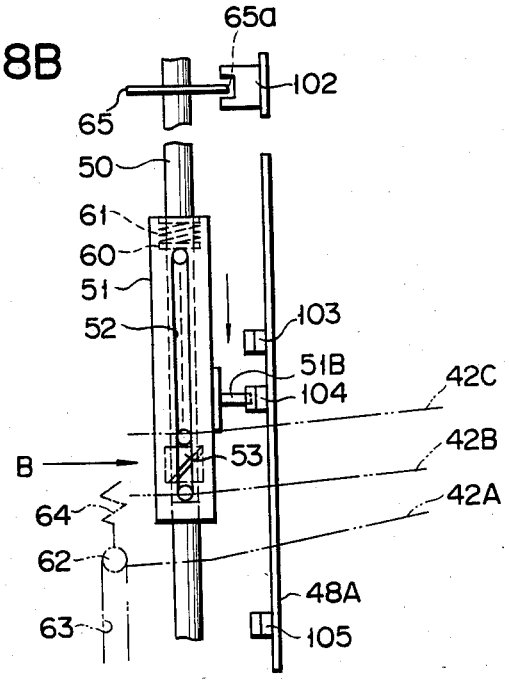

In the sort mode, when an operation key is depressed, the bin actuating motor 56 is driven through the controller 100. As a result, the pair of sprockets 55 are rotated through the sprocket 57, the idler gear 59 and the endless chain 58. Upon rotation of the pair of sprockets 55, the rotating shaft 50 is driven in the direction indicated by the arrow of FIG. 6 (forward direction). Further, the cam 53 of the rotating shaft 50 is simultaneously driven. The sliders **44*a* and 44*b* of the bin 42B located horizontally above the cam 53 are guided into the groove 53*a* of the cam 53 through the inlet port (upper port) thereof and are moved from the outlet port (lower port) of the groove 53*a* to a horizontal position below the cam 53. When the bin 42B is being moved below the cam 53, the sliders 44*a* and 44*b* of the bin 42C simultaneously come in contact with the upper horizontal portion of the cam 53 by the urging force of the compression spring 61. As a result, the space between the bin 42B and the bin 42C is widened and the paper storage section 31 is formed (FIG. 17B). The positional relations between the movable member 51 and the respective detectors is shown in FIG. 18B. The sliders of the bins 42C and 42B which are, respectively, in contact with the upper and lower surfaces of the cam 53 mounted to the rotating shaft 50 and are located in the lower part of the elongate hole 52 of the movable member 51. Other sort bins 42D through 42K are stored in the upper part of the elongate hole 52. Therefore, the movable member 51 moves downward and the detector dog 51B is simultaneously moved downward to turn off the SHOM detector 104. At this time, the sort home position signal SHOM is obtained. When the rotating shaft 50 revolves once, the notched portion 65*a* of the disc 65 is detected by the OPTO detector 102. As a result, the one revolution detection signal OPTO is output by the OPTO detector 102 and the bin actuating motor 56 stops rotating. In this condition, the copying operation of the copying machine 1 is performed and the copying paper sheet P on which the toner image is fixed is fed out through the delivery rollers 28. Thus, the delivered copying paper sheet P is guided into the sorter 15 through the transfer rollers 25*a* and 25*b*. The copying paper sheet P is then stored between the bins 42B and 42C. When the PIB detector 101 disposed to be adjacent to the delivery rollers 28 detects the trailing end of the copying paper sheet P, the detection signal PIB is supplied to the controller so that the bin actuating motor 56 starts rotating. Upon rotation of the bin actuating motor 56, the pair of sprockets 55 are rotated through the sprocket 57, the idler gear 59 and the endless chain 58. When the pair of sprockets 55 are driven, the rotating shaft 50 is rotated in the direction indicated by the arrow of FIG. 6 (forward direction). Further, the cam 53 of the rotating shaft 50 is simultaneously driven. The sliders 44*a* and 44*b* of the bin 42C located horizontally above the cam 53 are guided into the groove 53*a* of the cam 53 through the inlet port (upper part) thereof and are moved from the outlet port (lower part) of the groove 53*a* to a horizontal position below the cam 53. When the bin 42C is moved to the horizontal position below the cam 53, the sliders 44*a* and 44*b* of the bin 42D simultaneously come in contact with the upper horizontal portion of the cam 53 by the urging force of the compression spring 61. As a result, the space between the bin 42C and the bin 42D is widened and the paper storage section 31 is formed. When the notched portion 65*a* of the disc 65 mounted to the rotating shaft 50 is detected by the OPTO detector 102, the OPTO detector 102 outputs the signal so as to stop the rotation of the bin actuating motor 56. In this condition, the copying paper sheet P is fed out through the delivery rollers 28 and guided into the sorter 15. The copying paper sheet P guided into the sorter 15 through the transfer rollers 25*a* and 25*b* is stored between the bin 42C and the bin 42D (FIG. 17C**).

Figure 17D:
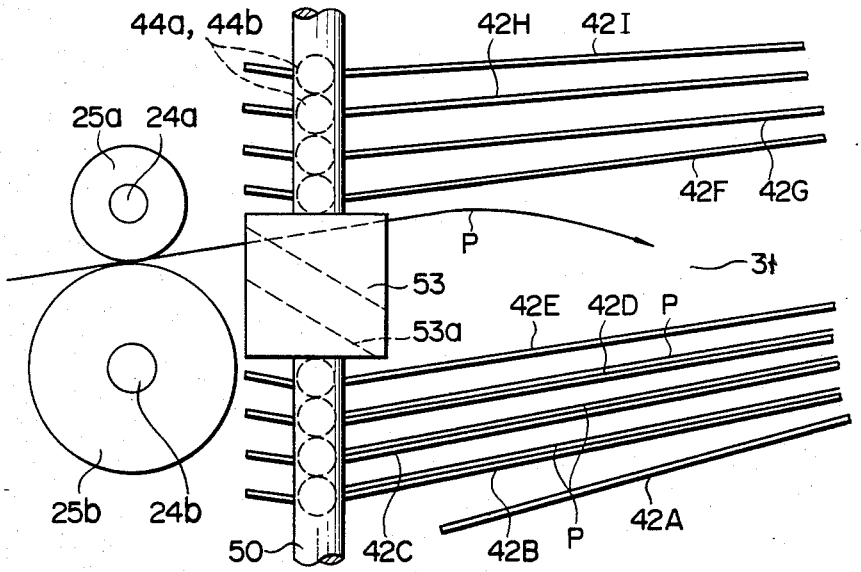

The above operation is repeated until the last copying paper sheet of, for example, four sets of copied paper sheets are stored in the paper storage section 31 between the bin 42E and the bin 42F. Even if the trailing end of the copying paper sheet P is detected by the PIB detector 101, the last paper signal 71 is supplied from the copying machine 1 to the controller. As a result, the bin actuating motor 56 remains stopped. Assume that the operator removes the first document of the set of documents and places a second document on the document table 7 and depresses the copy button to perform copying. The toner image is fixed on the copying paper sheet P which is, in turn, fed out through the delivery rollers 28 and guided into the sorter 15. The copying paper sheet P guided into the sorter 15 through the transfer rollers **25*a* and 25*b* is stored in the paper storage section 31 between the bin 42E and the bin 42F (FIG. 17D). When the PIB detector 101 which is adjacent to the delivery rollers 28 detects the trailing end of the copying paper sheet P, the detection signal PIB is supplied to the controller and the bin actuating motor 56 is rotated in the reverse direction, that is, the sort bins are moved upward. Upon the reverse rotation of the bin actuating motor 56, the pair of sprockets 55 are driven in the reverse direction through the sprocket 57, the idler gear 59 and the endless chain 58. When the pair of sprockets 55 are driven in the reverse direction, the rotating shaft 50 is rotated in the reverse direction. Thus, the cam 53 of the rotating shaft 50 is also rotated in the reverse direction. As a result, the sliders 44*a* and 44*b* of the bin 42E located in the horizontal position below the cam 53 are guided into the groove 53*a* of the cam 53 through the inlet port (lower portion) of the cam 53 and are moved to the horizontal position above the cam 53 through the groove 53***a* and the outlet port (upper part) of the cam 53. The bin 42F located above the cam 53 is pushed upward by the lifted bin 42E against the urging force of the compression spring 61. The distance between the bin 42E and the bin 42F becomes substantially the same as the diameter of the sliders 44*a* and 44*b* mounted to the bin 42E and the bin 42F, respectively. The bin 42F is located above the transfer surface B of the copying paper sheet P. When the bin 42E is moved to the horizontal position above the cam 53, the sliders 44*a* and 44*b* of the bin 42D simultaneously come in contact with the lower horizontal position below the cam 53. As a result, the space between the bin 42E and the bin 42D is widened to form the paper storage section 31. When the notched portion 65*a* of the disc 65 mounted to the rotating shaft 50 is detected by the OPTO detector 102, the bin actuating motor 56 stops rotating in response to the detection signal OPTO. In this condition, the second copying paper sheet of the second document is fed out through the delivery rollers 28 and guided into the sorter 15. The copying paper sheet P guided into the sorter 15 through the transfer rollers 25*a* and 25*b* is stored in the paper storage section 31 between the bin 42D and the bin 42E.

Figure 18C:
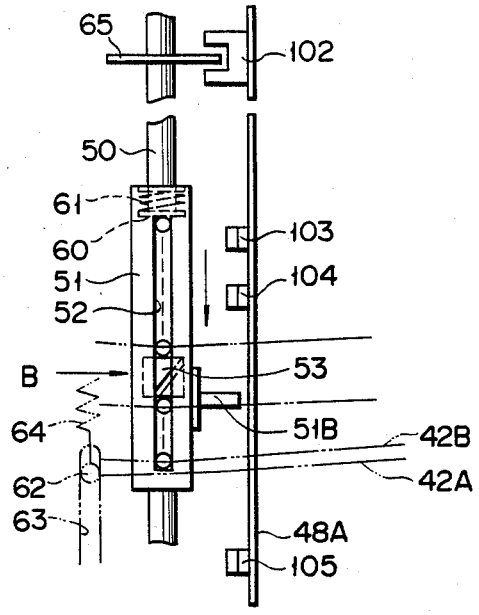

The positional relations between the movable member 51 and other members in the sorting operation are shown in FIG. 18C. The detector dog 51B is moved upward and downward between the SHOM detector 104 and LPOS detector 105. Therefore, detection signals are not generated by the detectors 103 through 105. Every time the rotating shaft 50 revolves, the OPTO detector 102 generates the detection signal OPTO. The sort bins except for the bin 42A are stacked above the non-sort bin 42A. The non-sort bin 42A is pushed down by the descending sort bin 42B. Thus, the pin 62 in the elongate hole 63 is moved downward against the urging force of the tension spring 64. As a result, the sort bins located below the cam 53 are pushed up by the non-sort bin 42A, thus accomplishing a smooth lifting operation.

Figure 18D:
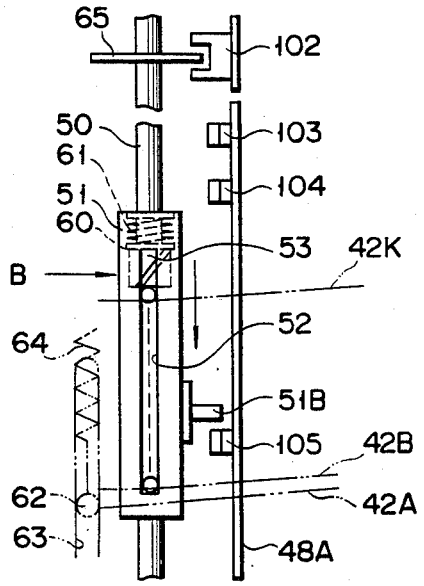

Assume that all the sort bins 42B through 42K are used for sorting. The positional relations between the movable member 51 and other members at the end of the first sorting operation are shown in FIG. 18D. The sliders of the 10 sort bins 42B through 42K the uppermost slider of which is defined by the lower surface of the cam 53 and the lowermost slider of which is defined by the bottom surface of the elongate hole 52 are stored in the elongate hole 52 formed in the movable member 51. In this condition, the detector dog 51B mounted at the side of the movable member 51 is located slightly above the LPOS detector 105. When the bin actuating motor 56 happens to be driven in the forward direction and when the movable member 51 is moved slightly downward, the detector dog 51B is moved to turn off the LPOS detector 105. As a result, the detection signal LPOS is generated from the LPOS detector 105 and the bin actuating motor 56 stops rotating, preventing the interruption of the mechanism. When the pin 62 in the elongate hole 63 formed in the frame 48 is moved downward against the urging force of the tension spring 64, the non-sort bin 42A is also moved downward.

Upon completion of the copying operation, when the operator depresses a sort button or when a predetermined period of time elapses, the bin actuating motor 56 is driven in response to the signal from the copying machine 1 and the sort bins 42 are pushed up by the cam 53. When all the sort bins 42 are pushed up, the detector dog 51B at the side of the movable member 51 is moved to the position where the NHOM detector 103 is located. As a result, the NHOM detector 103 is turned off and the bin actuating motor 56 stops rotating. Thus, the non-sort mode is restored in the sorter 15.

When the four sets of copying paper sheets of the predetermined copying sheet number are copied, the operator lifts the central portion of the bins 42 to sequentially take out the sorted copying paper sheets P from the paper storage section 31.

In the above embodiment, the copying paper sheets are stored in the lowermost bin 42A in the non-sort mode. On the other hand, in the sort mode, the first copied paper sheets are stored from the lowest bin except for the non-sort bin 42A to the upper bins and the second copied paper sheets are stored from the upper bins to the lower bins. However, the bin 42 for the non-sort mode may be placed at the uppermost position and, in the sort mode, the first copied paper sheets may be stored from the upper bins to the lower bins. In this case, the upper cover of the sorter 15 and at least part of the uppermost bin may be made transparent to check the copying condition. Further, in the above embodiment, the paper storage sections are separately formed in the sort and non-sort modes. However, the paper storage section in the non-sort mode may be used as the first paper storage section in the sort mode.

Figure 20A:
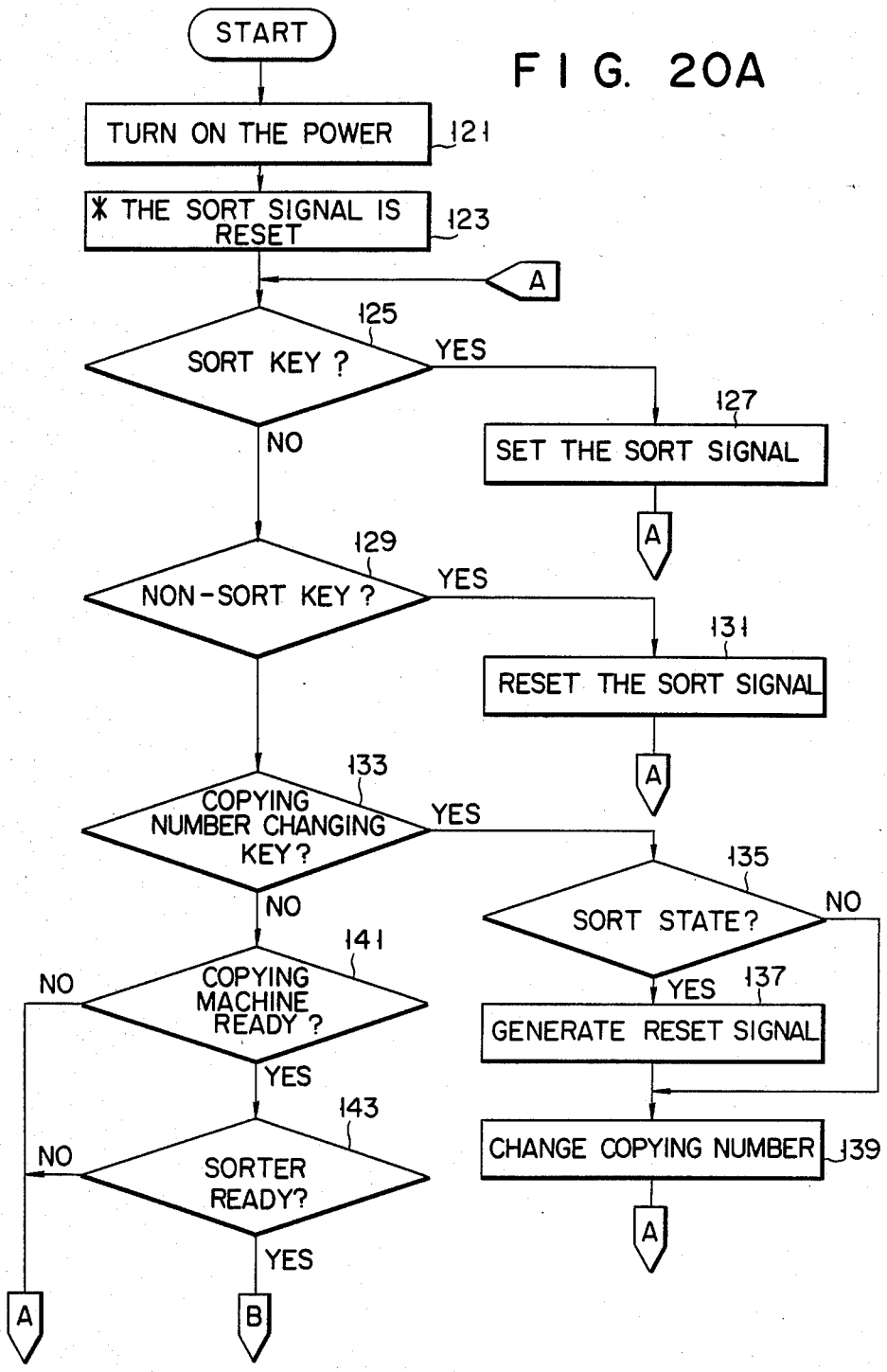
FIGS. 20A and B and 21A–E are flow charts for explaining the mode of operation of the controller.
Figure 20B:
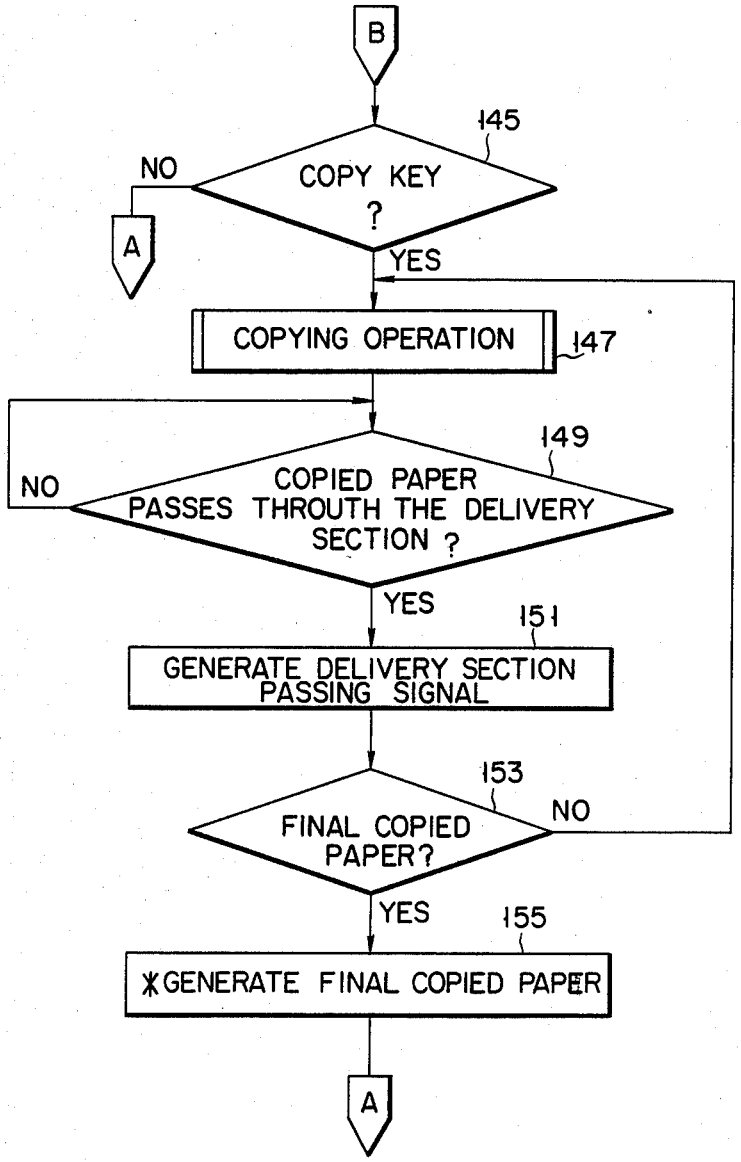
Figure 21A:
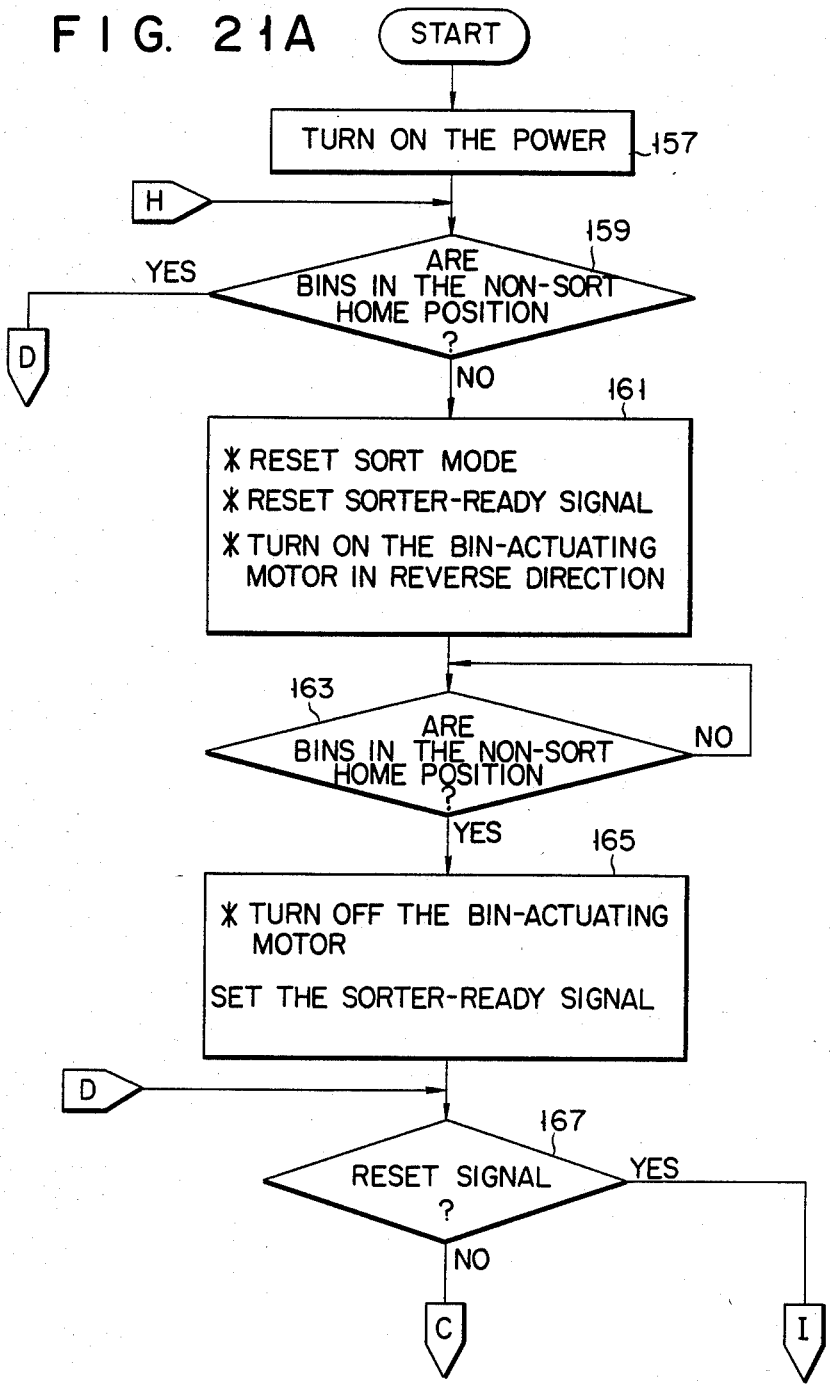
Figure 21B:
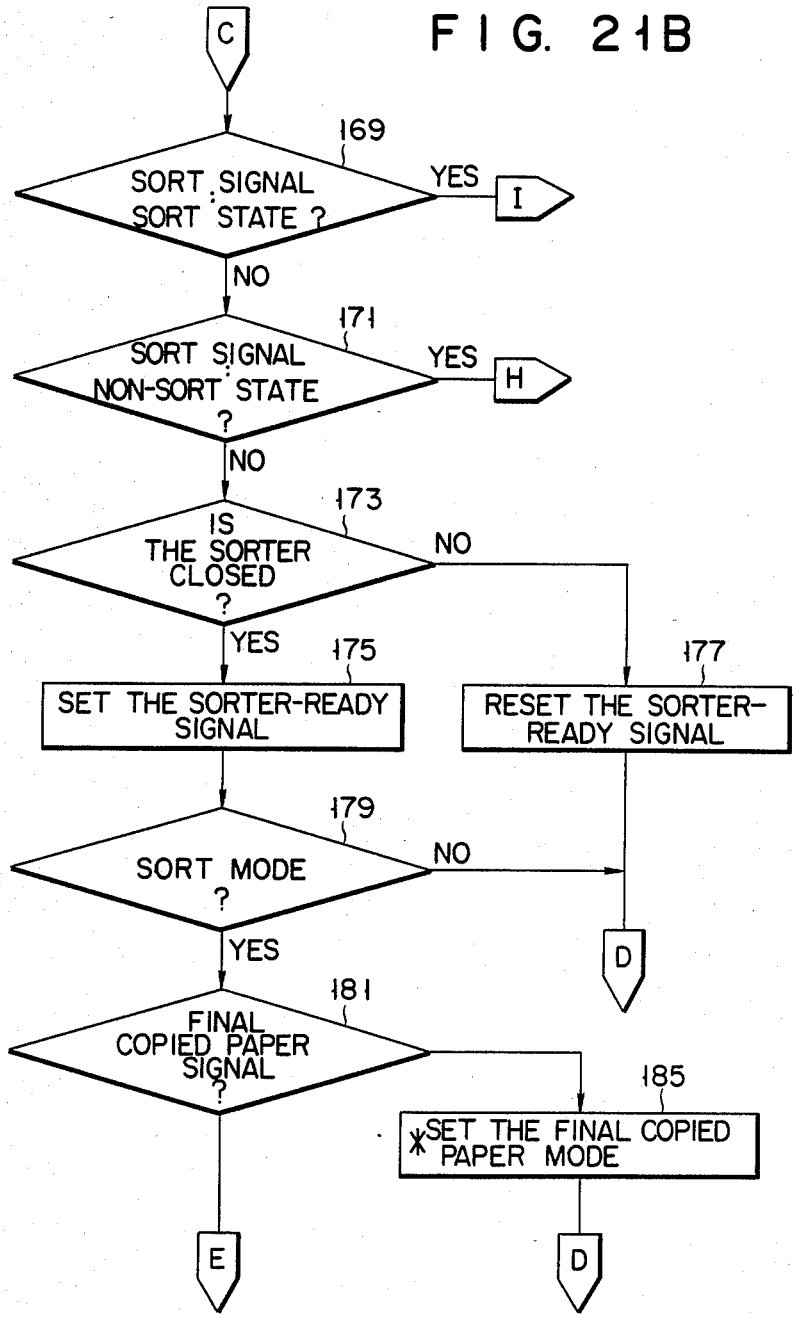
Figure 21C:
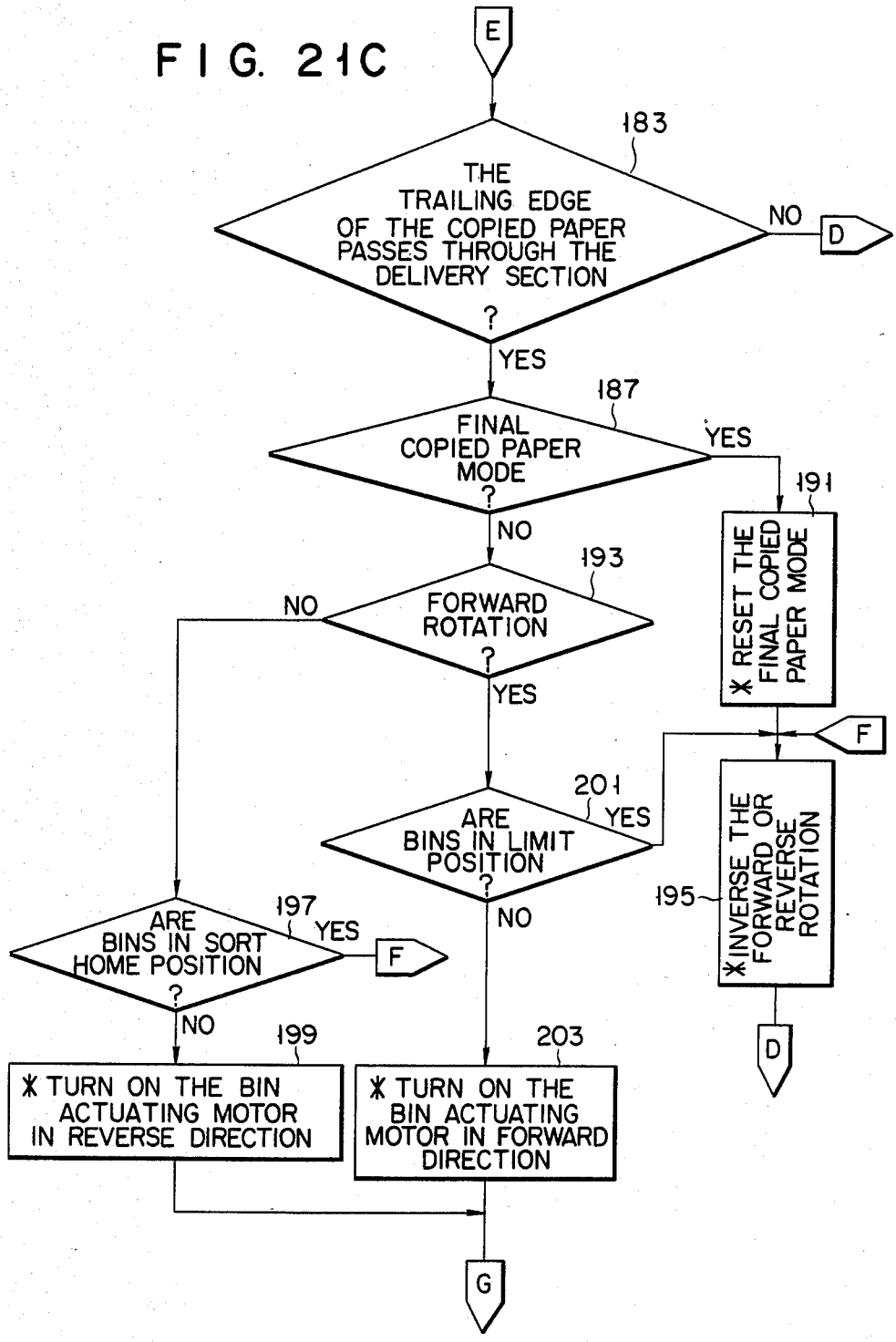
Figure 21D:
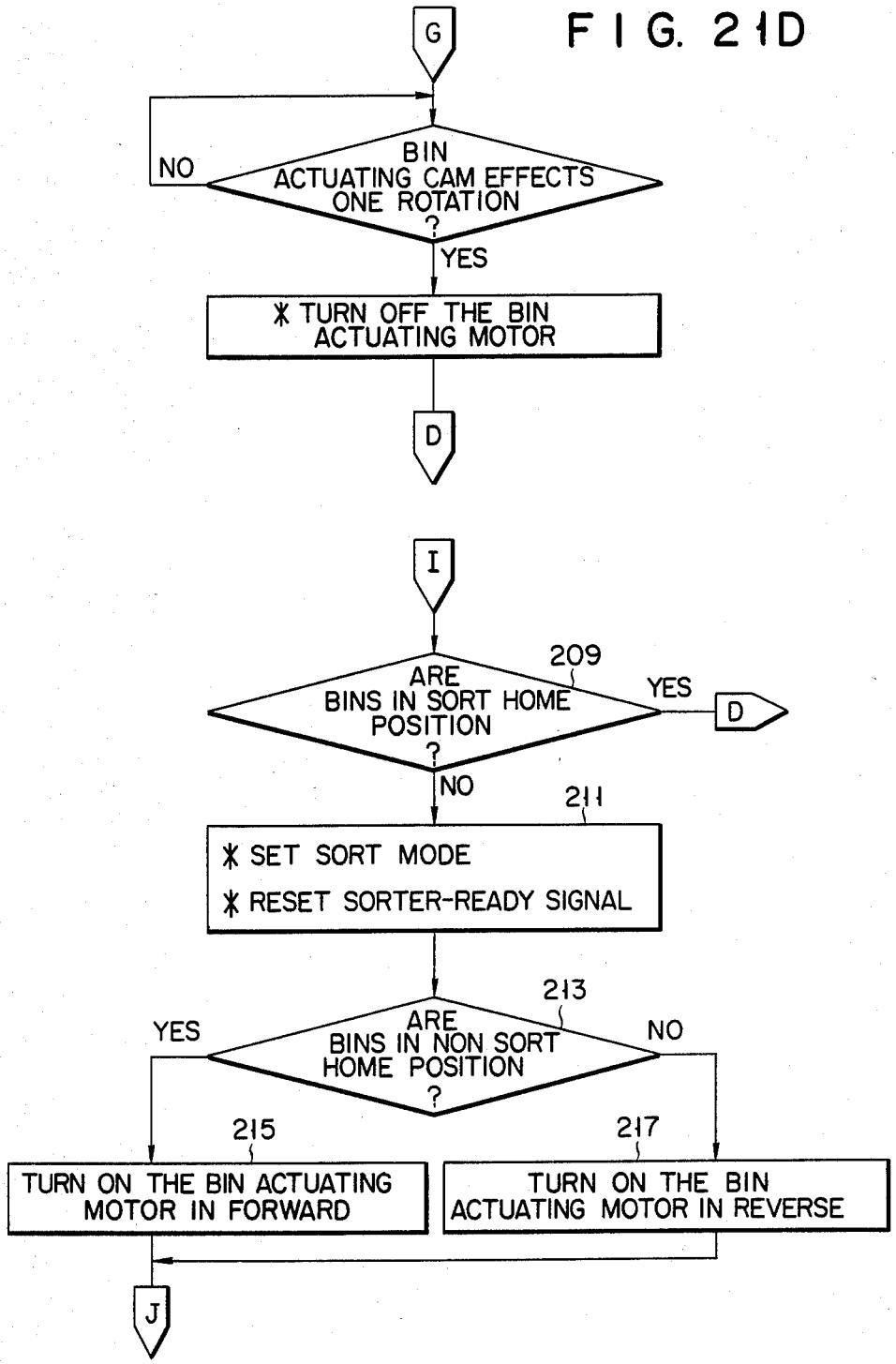
Figure 21E:
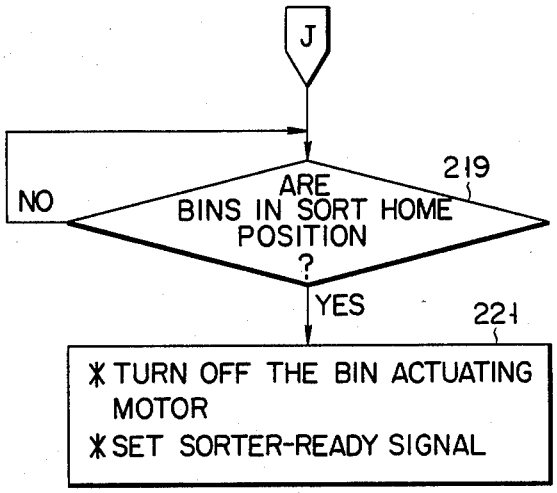

The mode of operation of the controller of the sorter and the control section of the copying machine main body will be described with reference to the flow charts in FIGS. 20 and 21.

The mode of operation of the copying machine main body will be first described with reference to the flow chart in FIG. 20. Only parts which are related to the sorter will be described. When power is supplied in step 121, the initial reset of the sort signal is performed in step 123. Thus, the sort key is ready for use. When the sort key is depressed, the sorter lamp is lit, indicating that the sort mode is initialized. When the sort key is depressed again, the sorter lamp is turned off, indicating that the non-sort mode is initialized. It is judged in step 125 whether the sort key on the copying machine main body is depressed. If the sort key is depressed, the sort signal 72 is set in step 127. On the other hand, when the sort key is not depressed, it is judged in step 129 whether the non-sort key is depressed. If the non-sort key is depressed, the non-sort signal 73 is generated. Further, the sort signal is reset in step 131 and the program returns to step 125. On the other hand, when the non-sort key is not depressed, it is judged that the sort mode is initialized and the program advances to step 133. The operator checks that the sorter lamp is on and enters data for a preset copying sheet number by the numeric keys. The preset copying sheet number is then displayed. It is then judged in step 133 whether the change key for changing the preset copying sheet number is depressed. If the change key is depressed, it is judged in step 135 whether the current mode is the sort mode. If the current mode is the sort mode, the reset signal 74 as described before is generated in step 137. When the reset signal 74 is generated and when it is judged whether the current mode is not the sort mode in step 135, the preset copying sheet number is changed in step 139 and the program returns to step 125. However, if the change key has not been depressed in step 133, it is judged in step 141 whether the copying machine is maintained in the ready mode. If it is ready, the program advances to step 143. It is judged in step 143 by the output from the sorter ready circuit 114 whether the sorter ready mode is initialized. If the sorter ready mode is initialized, it is judged in step 145 whether the copy key is depressed. If the copy key is depressed, the program advances to step 147. The copying operation is performed in step 147. However, when the copying machine is not maintained in the ready mode in step 141, the program returns to step 125 only if the sorter ready mode is not initialized in step 143 and the copy key is not depressed in step 145. After the copying operation is completed in step 147, it is judged in step 149 whether the copying paper sheet has passed through the delivery section. If the copying paper sheet has passed through the delivery section, the detection signal PIB is output by the PIB detector 101. Further, it is judged in step 153 whether the current copying paper sheet is the last copied paper sheet. If it is the last copied paper sheet, the last paper signal 71 as described above is generated in step 155. The program then returns to step 125. On the other hand, if the current copying paper sheet is not last copied paper sheet, the program returns to step 147 and the copying operation is performed again. Data up to 10 may be entered while the sorter lamp is turned on. When the data for the preset copying sheet number of 11 is entered, this entry is regarded as an error. When the copy key is depressed while the sorter lamp is off, the copied paper sheets are sorted in the non-sort bin 42A (non-sort mode). Further, when the copy key is depressed while the sorter lamp is on, the copied paper sheets are sequentially stored from the specified bin in a manner as described below.

The mode of operation of the controller of the sorter will be mainly described with reference to the block diagram of FIG. 16 and the flow chart of FIG. 21.

(A) Positioning to Non-Sort Home Position

When power is supplied in step 157, it is judged in step 159 whether the sort bins are positioned in the non-sort home position. This judgment is made according to the presence or absence of the detection signal NHOM from the NHOM detector 103. If the sort bins are not located in the non-sort home position, the sort key is depressed again in step 161 and the sort mode is then reset. Thus, the non-sort signal 73 is generated. The motor inverting circuit 111 of FIG. 16 detects the changeover from the sort mode to the non-sort mode and outputs the motor reverse rotation signal (UP). Simultaneously, the sorter ready circuit 114 is reset by the non-sort signal 73 and an inverted signal $\overline{\text{NHOM}}$ of the detection signal NHOM and the non-ready signal is output thereby. The mode designating circuit 112 outputs the non-sort mode signal. The positioning circuit 113 outputs the positioning signal RUN in response to the non-sort signal 73 and the inverted signal $\overline{\text{NHOM}}$. As a result, the motor drive control circuit 110 outputs an inverting signal in response to the non-sort mode signal from the mode designating circuit 112 and the positioning signal RUN from the positioning circuit 113. Thus, the bin actuating motor 56 is rotated in the reverse direction. It is judged in step 163 whether the bins are positioned in the non-sort home position. If they are not positioned in the non-sort home position, the reverse rotation of the bin actuating motor 56 continues until the detection signal NHOM is supplied to the positioning circuit 113. When the bins reach the non-sort home position, the stop signal STOP is generated from the positioning circuit 113 in step 165 so as to stop the rotation of the bin actuating motor 56. The detection signal NHOM is also supplied to the sorter ready circuit 114. The program then advances to step 167.

(B) Positioning to Sort Home Position

It is judged in step 167 whether the reset signal 74 is output by the copying machine main body 2. If the reset signal 74 is not generated, it is judged in step 169 whether the non-sort mode is changed to the sort mode. If the sort signal is not generated yet, it is further judged in step 171 whether the sort mode is changed to the non-sort mode. When the reset signal 74 is received in step 167 and when the non-sort mode is changed to the sort mode in step 169, the program advances to step 209. At a timing of the change of mode of the sort signal, the output from the motor inverting circuit 111 is inverted. The motor inverting circuit 111 and the positioning circuit 113 are operated in response to the signals described above and the positioning operation for the initial status is performed as described below. It is judged in step 209 whether the bins are positioned in the sort home position. If they are not positioned in the sort home position, the mode designating circuit 112 is set to the sort mode in step 211. Further, the sorter ready circuit 114 is reset. Thereafter, it is judged in step 213 whether the bins are positioned in the non-sort home position. If they are positioned in the non-sort home position, the motor forward drive signal DWN from the motor inverting circuit 111 and the positioning signal RUN from the positioning circuit 113 are generated to drive the motor drive control circuit 111 and then the bin actuating motor 56 in the forward direction. On the other hand, when the bins are not positioned in the non-sort home position, the motor reverse drive signal UP is generated by the motor inverting circuit 111 in step 217. Thus, the bins are moved upward. It is then judged in step 219 whether the bins are positioned in the sort home position. If they are positioned in the sort home position, the detection signal SHOM is generated by the SHOM detector 104 in step 221 and the stop signal STOP is generated by the positioning circuit 113. Thus, the bin actuating motor 56 stops rotating. At the same time, the sorter ready circuit 114 is set and the sorter ready signal is supplied to the copying machine main body 2.

(C) Sort Mode

When the bins are positioned in the sort home position, the following operations are performed. It is judged in step 173 whether the sorter is closed. This judgment is made by the status of the signal from the door switch 106. If the sorter 15 is closed, the sorter ready circuit 114 is set in step 175. Thus, the sorter ready signal is generated by the sorter ready circuit 114. In this condition, the copying operation can be performed. However, when the sorter is not closed, the sorter ready signal is reset in step 177 and the copying operation is interrupted until the sorter is closed. When the sorter is closed, it is judged in step 179 whether the sort mode is initialized. If the sort mode is initialized, it is then judged in step 181 whether the last paper signal 71 is generated. If the last paper signal 71 is not generated, it is judged in step 183 whether the trailing end of the first copied paper sheet is detected by the LPOS detector 105. When the detection signal PIB is generated in step 183, it is judged in step 187 whether the current status is the last copied paper status. When the last copied paper signal 71 is output in step 181, the last copied paper status is set in step 185 and the bin actuating motor 56 stops rotating. When the last copied paper status is initialized in step 187, the last copied paper status is reset in step 191. In response to the last copied paper signal 71 and the detection signal PIB from the PIB detector 101, the output from the motor inverting circuit 111 is inverted to the motor reverse rotation instruction signal UP or the motor forward rotation instruction signal DWN in step 195. When the motor drive control circuit 110 receives one of the instruction signals, the motor drive control circuit 110 serves to rotate the bin actuating motor 56 in the reverse or forward direction. The control program then returns to step 167. When the last copied paper status is not initialized, it is judged in step 193 whether the bin actuating motor is driven in the forward direction. If the bin actuating motor is driven in the forward direction, it is judged in step 201 whether the bins are positioned in the limit position. However, if the bin actuating motor is not driven in the forward direction in step 193, it is judged in step 197 whether the bins are positioned in the sort home position. If the bins are not positioned in the sort home position, the bin actuating motor is driven in the reverse direction in step 199. When the bin actuating motor is driven in the forward or reverse direction, it is judged in step 205 whether the cam 53 revolves once. When one revolution of the cam 53 is detected, the bin actuating motor stops rotating in step 207. When it is detected in step 201 of the flow chart that the bins are positioned in the limit position, the bin actuating motor stops rotating and is immediately driven in the reverse direction. By repeating such steps, the sorting operation is performed.

In the above embodiment, the copied paper sheets for the first document are sorted from the lower bins except for the non-sort bin 42A to the upper bins and the copied paper sheets for the second document are sorted from the uppermost bins to the lower bins. However, the copied paper sheets for all the documents of a predetermined set of documents may be sorted from the bottom to the top. Further, in the above embodiment, the bins are movable. However, the bins may be fixed and the gates may be moved. Alternatively, a gate may be disposed in each bin and the gate thereof may be operated electrically.

Obviously, numerous (additional) modifications and variations of the present invention are possible in light of the above teachings. It is, therefore, to be understood that, written in the scope of the appended claims, the invention may be practiced otherwise than as specifically described herein.

What we claim is:

1. A sorter, electrically and mechanically connected to a copying machine main body, said sorter comprising:

reset signal generating means for generating a reset signal synchronously with the entry of a change in a preset copying sheet number by an operator;

sorting means including plural sort bins defining plural sort bin positions, a first sort bin at one end of said plural sort bins establishing a first sort home position and a last sort bin at an opposite end of said plural sort bins establishing a second sort home position, said sorting means for sorting copied paper sheets being fed out of said copying machine main body and into said sort bins alternately and repetitively in forward and reverse directions starting from either said first or second sort home positions; and control means operatively connected to said sorter means and said reset signal generating means for stopping said sorting means and thus stopping the sorting of said copied sheets at a respective one of said bin positions corresponding to said preset copying sheet number in response to the number of copied sheets being equal to said preset copying sheet number; and for either (a) resuming the sorting of said copied sheets beginning with said respective one sort bin position in the absence of said control means receiving said reset signal, or (b) resuming the sorting of said copied sheets by said sorting means beginning with either said first or second sort home positions in response to said control means receiving said reset signal indicative of a change in said preset copying sheet number.

2. A sorter according to claim 1, wherein said control means comprises:

(a) a motor for driving said bins upward and downward;

(b) a motor drive control circuit means, electrically connected to said motor, for controlling the rotation of said motor;

(c) motor inverting circuit means, electrically connected to said copying machine main body and to said motor drive control circuit means, for receiving said reset signal from said copying machine main body and for reversing the rotation of said motor;

(d) mode designating circuit means, electrically connected to said copying machine main body and to said motor drive control circuit means, for receiving the reset signal from said copying machine main body and for generating a sort control signal or a non-sort control signal; and (e) positioning circuit means, electrically connected to said copying machine main body and to said motor drive control circuit means, for supplying a motor rotation instruction signal to a stop signal to said motor.

3. A sorter according to claim 2, further comprising cam means mechanically coupled to said bins and to said motor, and rotation detector means, electrically connected to said motor drive control circuit for detecting the rotation of said cam means.

4. A sorter according to claim 2, further comprising sort home position detector means, electrically connected to said positioning circuit means, for detecting said sort home position of said bins and for supplying a detection signal to said positioning circuit means.

5. A sorter according to claim 2, further comprising non-sort home position detector means, electrically connected to said positioning circuit means, for detecting the non-sort home position of said bins and for supplying a detection signal to said positioning circuit means.

6. A sorter according to claim 2, further comprising sorter ready circuit means, electrically connected to said copying machine main body, for generating a sorter ready signal.

7. A sorter according to claim 2, further comprising interlock circuit means, electrically connected to said motor drive control circuit means and to said copying machine main body, for supplying a stop signal to said motor.

8. A sorter according to claim 6, further comprising limit position detector means, electrically connected to said sorter ready circuit means, for detecting the upper or lower limit of said bins and for supplying a detection signal to said sorter ready circuit means.

9. A sorter according to claim 7, further comprising door switch means, electrically connected to said interlock circuit means, for detecting opening/closing of a door of said sorter and supplying a detection signal to said interlock circuit means.

10. A sorter according to claim 2, wherein said motor inverting circuit means receives the sort signal, the non-sort signal, and a last copied paper signal which indicates the delivery of a last copied paper from said copying machine main body.

11. A sorter according to claim 2, wherein said positioning circuit means and said mode designating circuit means receive the sort signal and the non-sort signal which are supplied from said copying machine main body.

* * * * *